US007252374B2

(12) United States Patent
Usui et al.

(10) Patent No.: US 7,252,374 B2
(45) Date of Patent: Aug. 7, 2007

(54) INK-JET RECORDING APPARATUS HAVING INK-EXTRACTING MEMBER

(75) Inventors: Takamasa Usui, Nagoya (JP); Toyonori Sasaki, Anjo (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 306 days.

(21) Appl. No.: 11/004,970

(22) Filed: Dec. 7, 2004

(65) Prior Publication Data

US 2005/0140749 A1 Jun. 30, 2005

(30) Foreign Application Priority Data

Dec. 8, 2003 (JP) ..... 2003-409396
Feb. 9, 2004 (JP) ..... 2004-031844

(51) Int. Cl.
*B41J 2/17* (2006.01)

(52) U.S. Cl. ..... 347/84

(58) Field of Classification Search ..... 347/49, 347/84, 85

See application file for complete search history.

(56) References Cited

U.S. PATENT DOCUMENTS

| | | | | |
|---|---|---|---|---|
| 5,506,611 | A | 4/1996 | Ujita et al. | |
| 6,062,667 | A | 5/2000 | Matsui et al. | |
| 6,116,722 | A * | 9/2000 | Sato et al. | 347/85 |
| 6,312,084 | B1 | 11/2001 | Ujita et al. | |
| 6,702,433 | B2 * | 3/2004 | Kono | 347/85 |
| 7,004,564 | B2 * | 2/2006 | Steinmetz et al. | 347/49 |
| 7,090,341 | B1 * | 8/2006 | Miyazawa | 347/85 |
| 2002/0149646 | A1 | 10/2002 | Pawlowski, Jr. et al. | |

FOREIGN PATENT DOCUMENTS

| | | |
|---|---|---|
| EP | 0 778 147 A2 | 6/1997 |
| EP | 0 956 958 A2 | 11/1999 |
| EP | 1 127 696 A2 | 8/2001 |
| EP | 1 164 025 A1 | 12/2001 |
| EP | 1 281 526 A1 | 2/2003 |
| EP | 1 300 247 A2 | 4/2003 |
| EP | 1 403 068 A1 | 3/2004 |
| JP | A 3-197052 | 8/1991 |
| JP | 07-241998 | 9/1995 |

* cited by examiner

*Primary Examiner*—Hai Pham
*Assistant Examiner*—Carlos A. Martinez, Jr.
(74) *Attorney, Agent, or Firm*—Oliff & Berridge, PLC

(57) ABSTRACT

An ink-jet recording apparatus, includes an ink-extracting member which has an ink-extract passage as an inner passage formed therein and which is to be removably connected to an ink cartridge. The ink-extracting member is to be connected to the ink cartridge. The ink cartridge includes an ink-outlet valve member which shuts off a flow of the ink from the ink cartridge, and which establishes a state in which the ink can be extracted from the ink cartridge by the ink-extracting member when the ink-outlet valve member is pressed by the ink-extracting member. The ink-extracting member further includes, at an end portion thereof, an end face which abuts on the ink-outlet valve member, and at least one ink-extract communication opening which is formed at the end portion and which is formed in a peripheral wall of the ink-extracting member, so as to communicate with the ink-extract passage.

16 Claims, 10 Drawing Sheets

INK-JET RECORDING APPARATUS HAVING INK-EXTRACTING MEMBER

The present application is based on Japanese Patent Application Nos. 2003-40396 filed on Dec. 8, 2003, and 2004-031844 filed on Feb. 9, 2004, the contents of which are incorporated herein by reference.

BACKGROUND OF THE INVENTION

1. Field of the Invention

The present invention relates in general to an ink-jet recording apparatus, and more particularly to an ink-jet recording apparatus equipped with a hollow ink-extracting member and a hollow air-introducing member which are connected to an ink cartridge for communication with an interior of the ink cartridge.

2. Discussion of Related Art

In installing an ink cartridge on an ink-jet recording apparatus, the ink cartridge is pressed onto a mounting portion of the ink-jet recording apparatus. The ink cartridge includes a rubber plug which seals the ink cartridge for inhibiting communication between an interior and an exterior of the ink cartridge. The ink-jet recording apparatus is equipped with a hollow needle whose end is pointed and which protrudes so as to pierce the rubber plug of the ink cartridge. Upon installing the ink cartridge onto the mounting portion of the ink-jet recording apparatus, the hollow needle pierces the rubber plug, so that the hollow needle and the interior of the ink cartridge are brought into communication with each other, making it possible to supply the ink from the ink cartridge to the ink-jet recording apparatus. Since the hollow needle is disposed such that its pointed end is directed toward a user, it is needed to assure the user of safety for preventing the user from contacting the pointed end of the hollow needle.

U.S. Pat. Nos. 5,506,611, 6,062,667, and 6,312,084 corresponding to JP-A-3-197052 disclose an ink-jet recording apparatus equipped with a protective device for protecting a hollow needle. The protective device includes a protective plate interposed between the hollow needle and the cartridge insertion port for preventing the hollow needle from being exposed to the cartridge insertion port. When the ink cartridge is installed, the protective plate placed in a shielding position for shielding the hollow needle is unlocked, so that the hollow needle is exposed. When the ink cartridge is further pushed toward the hollow needle, the hollow needle pierces the rubber plug of the ink cartridge. In the meantime, when the ink cartridge is removed from the ink-jet recording apparatus, the protective plate is returned back to the shielding position by a coil spring and is held at the position by locking members. Thus, the hollow needle is prevented from being contacted by the user.

SUMMARY OF THE INVENTION

Since the disclosed ink-jet recording apparatus equipped with the protective device described above requires the protective plate, locking members, torsion coil spring, etc., space for installing those components is needed, whereby the ink-jet recording apparatus undesirably tends to be large-sized. Further, the manufacturing cost of the apparatus is inevitably pushed up due to an increase in the number of the required components.

It is therefore an object of the present invention to provide an ink-jet recording apparatus which can be produced at a reduced cost while assuring a user of improved safety.

The object indicated above may be achieved according to a first aspect of the present invention, which provides an ink-jet recording apparatus, comprising: a recording head which ejects ink to perform recording; and an ink-extracting member which has an ink-extract passage as an inner passage formed therein and which is to be removably connected to an ink cartridge that stores ink for extracting the ink from the ink cartridge to supply the ink to the recording head, wherein the ink-extracting member is to be connected to the ink cartridge including an ink-outlet valve member which shuts off a flow of the ink from the ink cartridge and which establishes a state in which the ink can be extracted from the ink cartridge by the ink-extracting member when the ink-outlet valve member is pressed by the ink-extracting member which abuts on the ink-outlet valve member upon connection of the ink-extracting member to the ink cartridge, and wherein the ink-extracting member further includes, at an end portion thereof, an end face which abuts on the ink-outlet valve member, and at least one ink-extract communication opening which is formed at the end portion and which is formed in a peripheral wall of the ink-extracting member, so as to communicate with the ink-extract passage.

In the ink-jet recording apparatus constructed according to the first aspect described above wherein the end portion of the ink-extracting member is not pointed, it is possible to prevent a user from being injured by contacting the ink-extracting member, assuring improved safety. Further, it is not necessary to additionally provide a suitable protective device for protecting or covering the ink-extracting member, avoiding increase in the size of the ink-jet recording apparatus and in the manufacturing cost of the apparatus owing to the reduced number of the required components.

Since the ink-extracting member has at least one ink-extract communication opening which is formed at the end portion thereof and which is formed in the peripheral wall thereof, for communication with the ink-extract passage, the ink-extract passage of the ink-extracting member is connected to an interior of the ink cartridge with high reliability for permitting a flow of the ink from the ink cartridge into the ink-extracting member even when the ink-extracting member is held in abutting contact with the ink-outlet valve member.

In a first preferred form of the above-indicated first aspect of the invention, the end face of the ink-extracting member is generally flat.

According to the above-described first preferred form, the ink-outlet valve member can be substantially uniformly pressed by the flat end face of the ink-extracting member, so that the ink-outlet valve member is prevented from being inclined, whereby a substantially constant flow of the ink is assured.

In a second preferred form of the above-indicated first aspect of the invention, the ink-extracting member has an end opening which is open in the end face thereof and to which the ink-extract passage is open, and each of the a least one ink-extract communication openings is a cutout which is formed at an end of the peripheral wall of the ink-extracting member and which is open in the end face.

According to the above-described second preferred form, in a state in which the ink-outlet valve member is pressed by the ink-extracting member which abuts on the valve member, the end opening of the ink-extracting member which is open in the end face thereof and the at least one ink-extract communication opening which is also open in the end face are inevitably located within the ink cartridge. According to this arrangement, the ink-extract passage of the ink-extracting member and the interior of the ink cartridge can communicate with each other via the communication opening.

In one advantageous arrangement of the second preferred form, the ink-extracting member is disposed such that the end opening is open upwards and the at least one ink-extract communication opening is formed so as to have a size determined such that an outer periphery of a surface of the ink in the ink-extracting member substantially reaches the end face of the ink-extracting member, the surface of the ink being concave owing to surface tension.

According to the above-described advantageous arrangement, when the ink cartridge is removed for replacement, for instance, the height level of the surface of the ink in the ink-extracting member is not lowered from the end opening thereof to a considerably large extent, in spite of the presence of the communication opening which is a cutout formed at the end of the peripheral wall of the ink-extracting member. Hence, when the ink is extracted from a new ink cartridge by mounting it on the apparatus, the amount or volume of the air entering the ink-extracting member can be minimized, thereby inhibiting the air from flowing into the recording head.

In a third preferred form of the above-indicated first aspect of the invention, the at least one ink-extract communication opening consists of a plurality of ink-extract communication openings which are formed in the peripheral wall so as to be spaced apart from each other with a substantially constant spacing distance.

According to the above-described third preferred form, the flow of the ink from the interior of the ink cartridge to the ink-extracting member can be made substantially uniform, thereby supplying the ink to the ink-extract passage of the ink-extracting member with high stability.

In a fourth preferred form of the above-indicated first aspect of the invention, the ink-extracting member is formed of a resin material.

According to the above-described fourth preferred form, the communication opening can be formed easily in the ink-extracting member, as compared in a case where a communication opening is formed in an ink-extracting member formed of a metal material. Therefore, this arrangement is effective to reduce a cost of manufacture of the ink-jet recording apparatus.

In a fifth preferred form of the above-indicated first aspect of the invention, the ink-extracting member is to be connected to the ink cartridge including a seal which is disposed downstream of the ink-outlet valve member and into which the ink-extracting member is inserted so that the seal comes into close contact with an outer surface of the ink-extracting member, and the at least one ink-extract communication opening is disposed, in a state in which the ink-extracting member is connected to the ink cartridge, at a position nearer to the ink-outlet valve member than a portion of the ink-extracting member with which the seal comes into close contact.

According to the above-described fifth preferred form, in a state in which the ink-extract passage of the ink-extracting member is connected, for fluid communication, to the interior of the ink cartridge with the ink-extracting member entered the interior of the ink cartridge, the ink can be prevented from leaking from the outer circumference of the ink-extracting member.

In one advantageous arrangement of the fifth preferred form, the ink-extracting member has at least one air-discharge passage for discharging air existing in a space located downstream of the ink-outlet valve member out into an exterior of the ink cartridge, upon insertion of the ink-extracting member into the seal.

The seal comes into close contact with the outer surface of the ink-extracting member when the ink-extracting member is inserted thereinto. If the ink-extracting member does not have the at least one air-discharge passage, the air existing in the space located downstream of the ink-outlet valve member may be compressed and may flow into the ink-extract passage of the ink-extracting member, causing a risk of preventing proper ink ejection. According to the above-described arrangement, the provision of the at least one air-discharge passage is effective to prevent the air flow into the ink-extract passage and maintain proper ink ejection.

In the above-described advantageous arrangement of the fifth preferred form, the at least one air-discharge passage is preferably formed so as to be held in communication with the exterior of the ink cartridge until the ink-extracting member substantially abuts on the ink-outlet valve member.

Where the at least one air-discharge passage is formed as described above, the air can be discharged until the ink-extracting passage is brought into communication with the interior of the ink cartridge, so as to prevent, with high reliability, the air from flowing into the ink-extract passage.

In the above-described advantageous arrangement of the fifth preferred form, the at least one air-discharge passage is preferably arranged such that communication between the space located downstream of the ink-outlet valve member and the exterior of the ink cartridge is shut off by the seal when the state in which the ink can be extracted from the ink cartridge by the ink-extracting member is established.

Where the at least one air-discharge passage is arranged as described above, the ink can be prevented from leaking through the at least one air-discharge passage to the exterior of the ink cartridge.

In the above-described advantageous arrangement of the fifth preferred form, each of the at least one air-discharge passage is preferably a groove formed in the outer surface of the ink-extracting member.

Where each of the at least one air-discharge passage is a cutout described above, the ink-extracting member can be easily manufactured, resulting in a reduction of the manufacturing cost.

In a sixth preferred form of the above-indicated first aspect of the invention, the ink-jet recording apparatus further comprises an air-introducing member which has an air-introduce passage as an inner passage formed therein and which is to be removably connected to the ink cartridge for introducing air into the ink cartridge, wherein the air-introducing member is to be connected to the ink cartridge including an air-inlet valve member which shuts off a flow of the air into the ink cartridge and which establishes a state in which the air can be introduced into the ink cartridge by the air-introducing member when the air-inlet valve member is pressed by the air-introducing member which abuts on the air-inlet valve member upon connection of the air-introducing member to the ink cartridge, and wherein the air-introducing member includes, at an end portion thereof, an end face which abuts on the air-inlet valve member, and at least one air-introduce communication opening which is formed at the end portion and which is formed in a peripheral wall of the air-introducing member, so as to communicate with the air-introduce passage.

According to the above-described sixth preferred form wherein the end portion of the air-introducing member is not pointed, it is possible to prevent a user from being injured by contacting the air-introducing member, assuring improved safety. Further, it is not necessary to additionally provide a suitable protective device for protecting or covering the air-introducing member, avoiding increase in the size of the ink-jet recording apparatus and in the manufacturing cost of the apparatus owing to the reduced number of the required components.

Since the air-introducing member has at least one air-introduce communication opening which is formed at the end portion thereof and which is formed in the peripheral wall thereof, for communication with the air-introduce passage, the air-introduce passage of the air-introducing member communicates with the interior of the ink cartridge with high reliability for permitting a flow of the air from the air-introduce passage to the interior of the ink cartridge even when the air-introducing member is held in abutting contact with the air-inlet valve member.

In one advantageous arrangement of the sixth preferred form, the end face of the air-introducing member is generally flat.

According to the above-described advantageous arrangement, the air-inlet valve member can be substantially uniformly pressed by the flat end face of the air-introducing member, so that the air-inlet valve member is prevented from being inclined, whereby a substantially constant flow of the air is assured.

In another advantageous arrangement of the above-described sixth preferred form, the ink-extracting member and the air-introducing member are the same in shape.

Where the ink-extracting member and the air-introducing member are the same in shape, the same components can be used in common for producing the ink-extracting member and the air-introducing member, resulting in reduction of the manufacturing cost.

The object indicated above may also be achieved according to a second aspect of the present invention, which provides an ink-jet recording apparatus, comprising: a recording head which ejects ink to perform recording; an ink which stores ink; and an ink-extracting member which has an ink-extract passage as an inner passage formed therein and which is to be removably connected to the ink cartridge for extracting the ink from the ink cartridge to supply the ink to the recording head, wherein the ink cartridge includes an ink-outlet valve member which shuts off a flow of the ink from the ink cartridge and which establishes a state in which the ink can be extracted from the ink cartridge by the ink-extracting member when the ink-outlet valve member is pressed by the ink-extracting member which abuts on the ink-outlet valve member upon connection of the ink-extracting pipe to the ink cartridge, and wherein the ink-extracting member further includes, at an end portion thereof, an end face which abuts on the ink-outlet valve member and at least one ink-extract communication opening which is formed at the end portion and which is formed in a peripheral wall of the ink-extracting member, so as to communicate with the ink-extract passage.

The ink-jet recording apparatus constructed according to the second aspect indicated above enjoys the same features and advantages as those described above with respect to the ink-jet recording apparatus constructed according to the first aspect indicated above.

The object indicated above may also be achieved according to a third aspect of the present invention, which provides an ink-jet recording apparatus, comprising: a recording head which ejects ink to perform recording; and an ink-extracting member which has an ink-extract passage as an inner passage formed therein and which is to be removably connected to an ink cartridge that stores ink for extracting the ink from the ink cartridge to supply the ink to the recording head, wherein the ink-extracting member is to be connected to the ink cartridge including: an ink-outlet valve member which shuts off a flow of the ink from the ink cartridge and which establishes a state in which the ink can be extracted from the ink cartridge by the ink-extracting member when the ink-outlet member is pressed by the ink-extracting member which abuts on the ink-outlet valve member upon connection of the ink-extracting member to the ink cartridge; and a seal which is disposed downstream of the ink-outlet valve member and into which the ink-extracting member is inserted so that the seal comes into close contact with an outer surface of the ink-extracting member, and wherein the ink-extracting member further includes: at least one ink-extract communication opening which is disposed, in a state in which the ink-extracting member is connected to the ink cartridge, at a position nearer to the ink-outlet valve member than a portion of the ink-extracting member with which the seal comes into close contact; and at least one air-discharge passage for discharging air existing in a space located downstream of the ink-outlet valve member out into an exterior of the ink cartridge, upon insertion of the ink-extracting member into the seal.

In the ink-jet recording apparatus constructed according to the above-described third aspect of the invention, the seal comes into close contact with the outer surface of the ink-extracting member when the ink-outlet valve member is pressed by the ink-extracting member inserted into the seal, so that the ink is prevented from leaking from the outer circumference of the ink-extracting member. Moreover, the air existing in the space located downstream of the ink-outlet valve member can be discharged out into the exterior of the ink cartridge through the at least one air-discharge passage, so that the air is prevented from flowing into the ink-extract passage of the ink-extracting member, assuring proper ink ejection.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which:

FIG. 5 are cross sectional views, wherein

FIGS. 6A-1, 6B-1, and 6C-1 are side views showing a process in which a break portion of the valve member breaks a thin film member and FIGS. 6A-2, 6B-2, and 6C-2 are plan views showing the process and respectively corresponding to FIGS. 6A-1, 6B-1, and 6C-1;

DETAILED DESCRIPTION OF THE PREFERRED EMBODIMENTS

Figure 1:
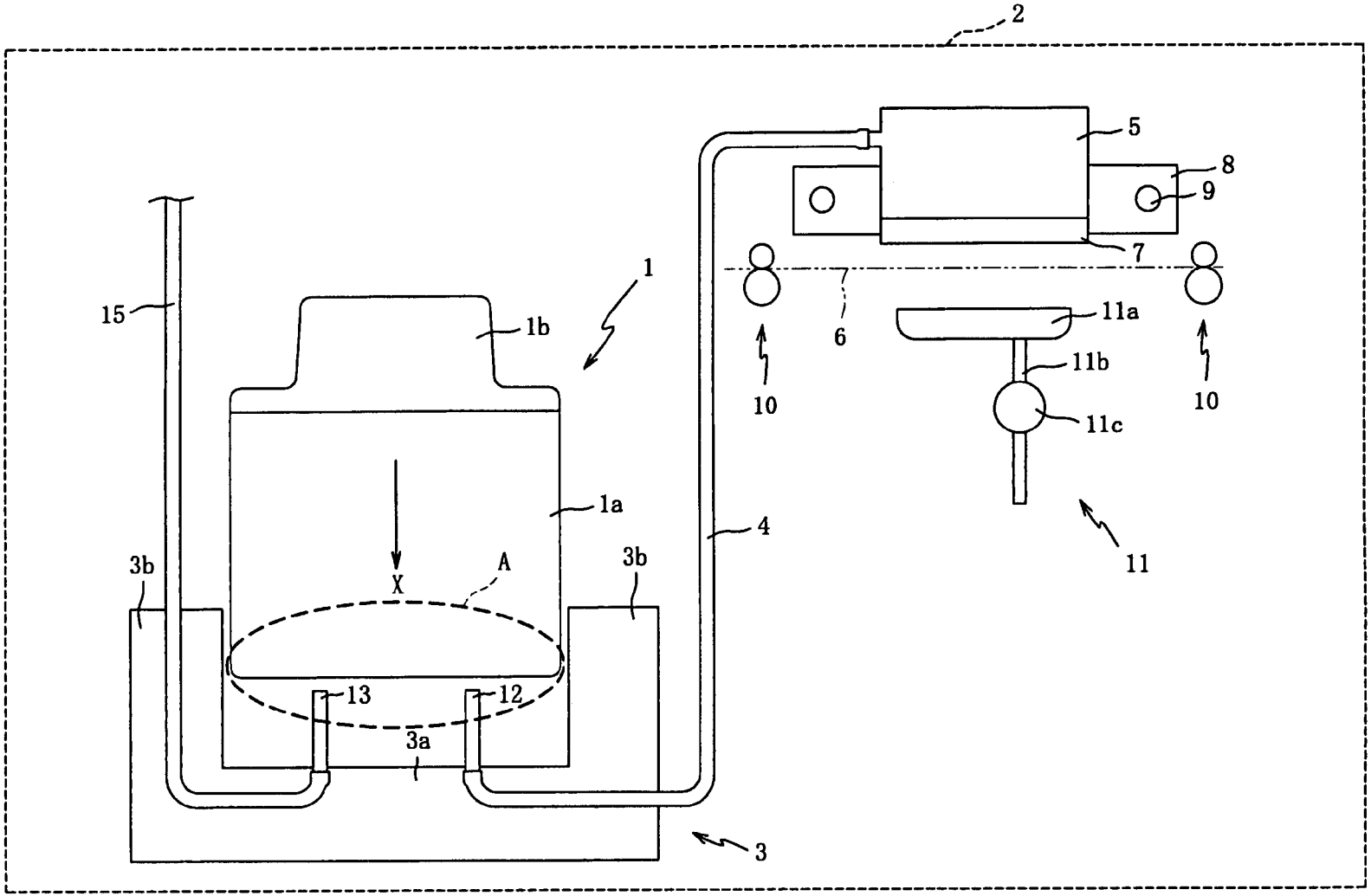
FIG. 1 is a view schematically showing an ink-jet recording apparatus to which the present invention is applied.

Referring to the drawings, there will be described preferred embodiments of the present invention. Referring first to FIG. 1 of the schematic view, there is shown an ink cartridge 1 and an ink-jet recording apparatus 2 on which the ink cartridge 1 is mounted, the ink cartridge 1 and the ink-jet recording apparatus 2 being constructed according to a first embodiment of the present invention.

The ink cartridge 1 is constructed to be removably mounted on the ink-jet recording apparatus 2 which includes a recording head 7 for ejecting ink. The ink cartridge 1 stores ink to be supplied to the recording head 7.

The ink cartridge 1 includes a hollow, box-like casing 1*a* which open upwards and a lid 1*b* which fluid-tightly closes the upper opening of the casing 1*a*. The ink to be supplied to the recording head 7 is stored in an ink chamber 16 (FIG. 2) formed in the casing 1*a*. On the ink-jet recording apparatus 2, there are mounted a plurality of ink cartridges which are filled with respective inks, i.e., cyan ink, magenta ink, yellow ink, and black ink.

The ink-jet recording apparatus 2 includes a mounting portion 3 on which the ink cartridge 1 is removably mounted, a tank 5 for storing the ink which is supplied from the ink cartridge 1 via an ink supply tube 4, the recording head 7 for ejecting the ink stored in the tank 5 toward a recording sheet 6, a carriage 8 on which the tank 5 and the recording head 7 are carried and which linearly reciprocates, a carriage shaft 9 which guides the reciprocating movement of the carriage 8, a sheet feeding mechanism 10 for feeding the recording sheet 6, and a purging device 11.

The mounting portion 3 includes a base portion 3*a* and guide portions 3*b* which extend from opposite ends of the base portion 3*a*. A hollow ink-extracting pipe 12 as an ink-extracting member and a hollow introducing pipe 13 as an air-introducing member are disposed so as to protrude from the base portion 3*a* interposed between the guide portions 3*b*. The ink-extracting pipe 12 is for extracting the ink stored in the ink cartridge 1 and the air-introducing pipe 13 is for introducing air into an interior of the ink cartridge 1.

The ink supply tube 4 is connected to one of opposite ends of the ink-extracting pipe 12, so that the ink-extracting pipe 12 communicates with the tank 5 via the ink supply tube 4. An air introduce tube 15 is connected to one of opposite ends of the air-introducing pipe 13, so that the air-introducing pipe 13 communicates with outside air via the air-introduce tube 15.

The ink cartridge 1 is mounted on the mounting portion 3 in a vertical direction indicated by an arrow "X" in FIG. 1. Upon mounting of the ink cartridge 1 on the mounting portion 3, the ink-extracting pipe 12 and the air-introducing pipe 13 respectively abut on valve members 32, 52 (FIG. 2) provided in the interior of the ink cartridge 1 and push up the valve members 32, 52 toward the ink chamber 16, whereby the ink-extracting pipe 12 and the air-introducing pipe 13 communicate with the ink chamber 16. The ink-extracting pipe 12 and the air-introducing pipe 13 extend in the vertical direction, and have respective end openings 85 (FIG. 4) at respective upper end portions at which the pipes 12, 13 are connected to the ink cartridge 1. Namely, the ink-extracting pipe 12 and the air-introducing pipe 13 are disposed such that the respective end openings 85 are open upwards. The valve member 32 functions as an ink-outlet valve member while the valve member 52 functions as an air-inlet valve member.

The recording head 7 has a plurality of nozzle openings at a surface thereof facing the recording paper 6. By driving an actuator including piezoelectric elements, the ink in the tank 5 is ejected from the nozzle openings toward the recording sheet 6. During a recording operation, the carriage 8 which carries the recording head 7 is reciprocably moved for performing the recording on the sheet 6.

The recording head 7 is disposed at a height position higher than a height position of the mounting portion 3. The ink in the nozzle openings is given a negative pressure (back pressure) owing to a head difference between the ink cartridge 1 mounted on the mounting portion 3 and the nozzle openings.

The purging device 11 is located outside a recording area so as to be opposed to the recording head 7. The purging device 11 has a purge cap 11*a* for closing the surface of the recording head 7 in which the nozzle openings are formed, a waste-ink tube 11*b* which communicates with the purge cap 11*a*, and a pump 11*c* for sucking poor-quality or waste ink from the nozzle openings via the waste-ink tube 11*b*.

For carrying out the purging operation, the carriage 8 is moved to a predetermined purging position and the surface of the recording head 7 in which the nozzle openings are formed is covered with the purge cap 11*a*. In this state, the pump 11*c* is driven, for thereby sucking the poor-quality ink which contains air bubbles, etc., and which exists within the recording head 7. The sucked poor-quality ink is stored in a waste-ink reservoir, not shown, through the waste-ink tube 11*b*. The recording operation and the purging operation are controlled by a CPU (Central Processing Unit), not shown, installed on the ink-jet recording apparatus 2.

Figure 2:
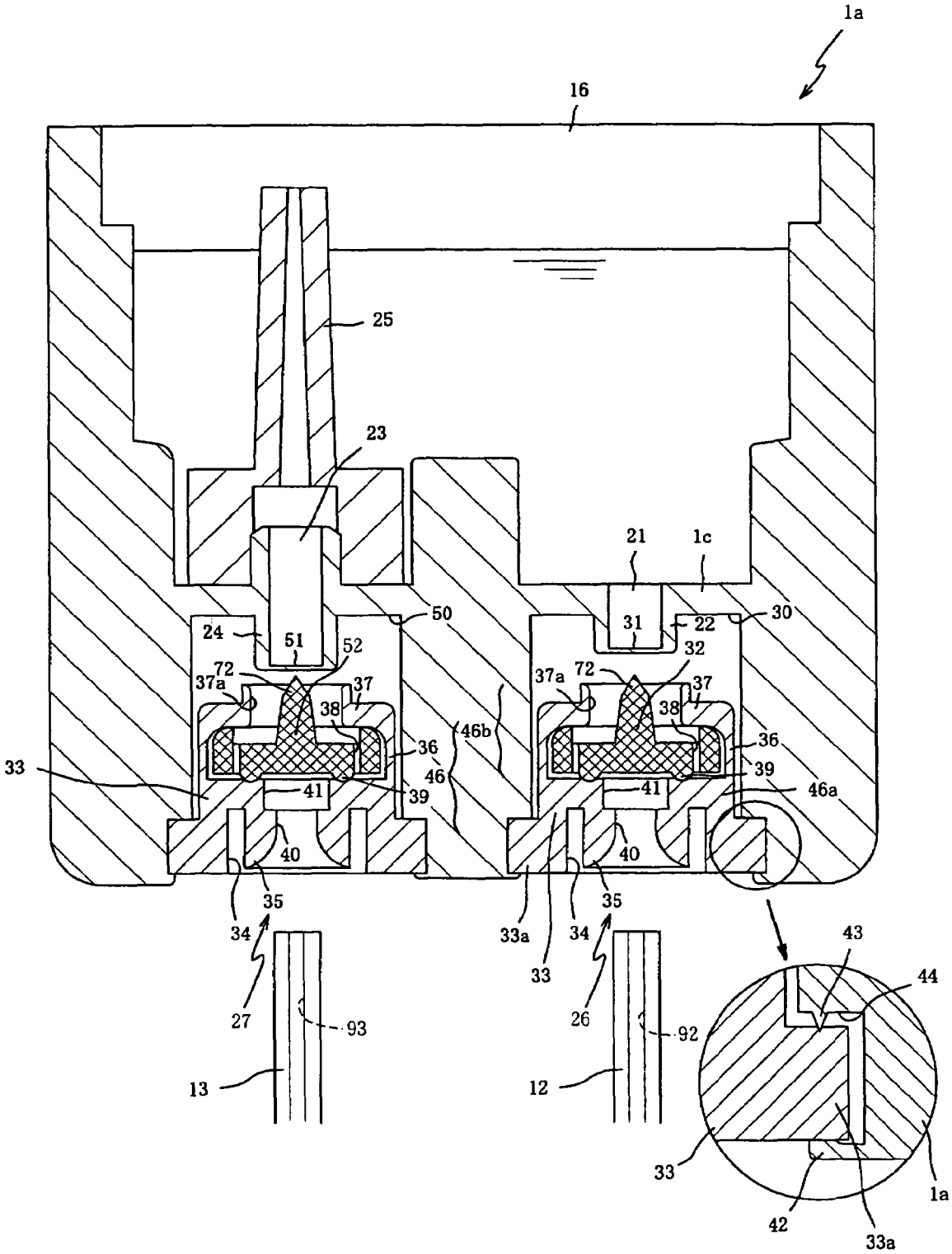
FIG. 2 is a cross sectional view showing a joint portion of an ink cartridge which is to be mounted on the ink-jet recording apparatus of FIG. 1 and which is constructed according to a first embodiment of the invention.
Figure 3:
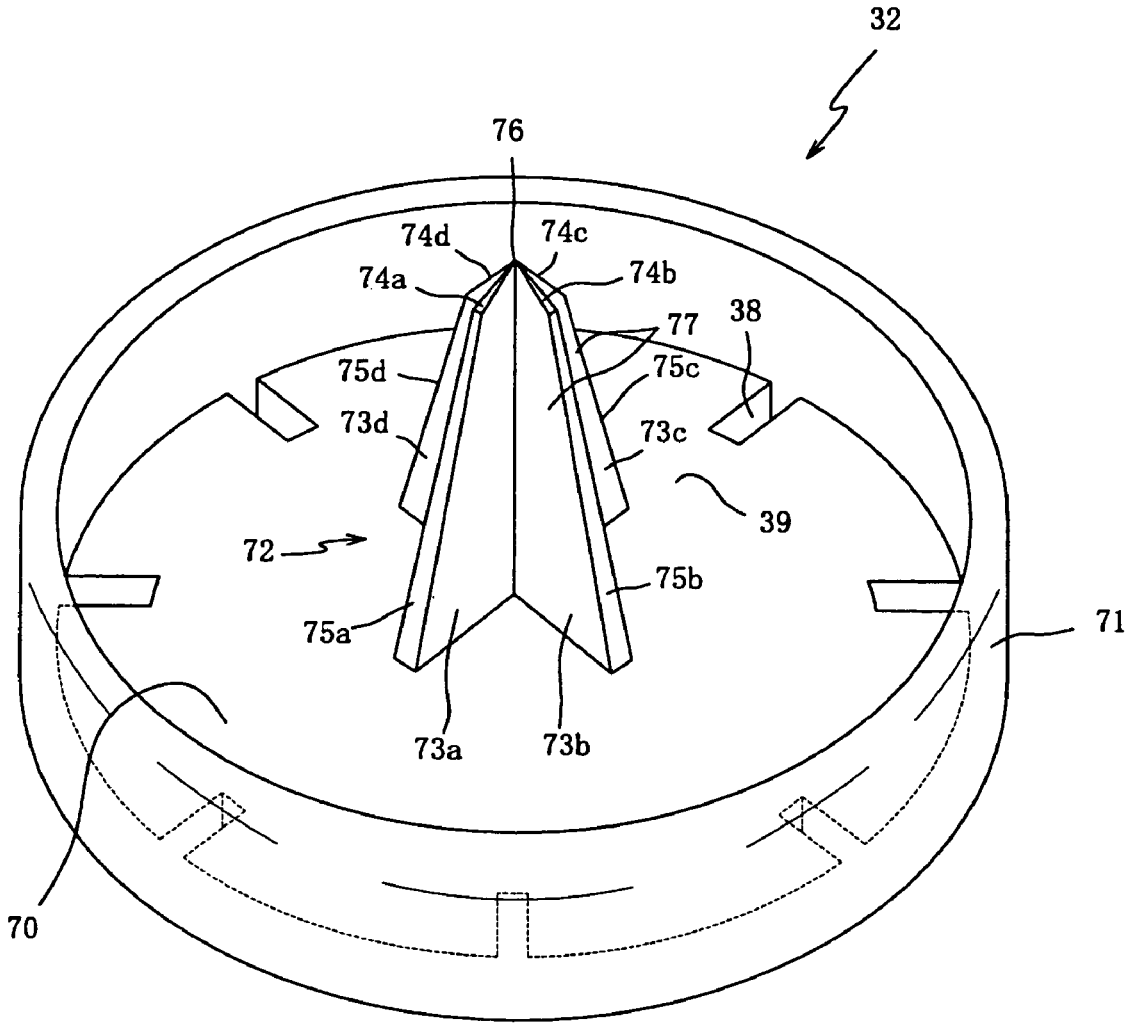
FIG. 3 is an enlarged view of a valve member of the ink cartridge of FIG. 2.

Referring next to FIGS. 2 and 3, there will be explained a structure of a joint portion of the ink cartridge 1 (enclosed with circle "A" in FIG. 1) at which the ink cartridge 1 is connected to the ink-jet recording apparatus 2. FIG. 2 shows the joint portion in a state before the ink cartridge 1 is mounted on the ink-jet recording apparatus 2. FIG. 3 is an enlarged perspective view showing the valve member 32.

The casing 1*a* of the ink cartridge 1 includes a cylindrical wall and a partition wall 1*c* which is formed integrally with the cylindrical wall and which divides an inner space of the cylindrical wall into an upper and a lower portion. The ink chamber 16 is formed in the upper portion. In the lower portion below the partition wall 1*c*, there are formed two communication chambers 30, 50 which are open downwards. When the ink cartridge 1 is mounted on the mounting portion 3, the ink-extracting pipe 12 is inserted into the communication chamber 30 and the air-introducing pipe 13 is inserted into the communication chamber 50. (Hereinafter, the communication chamber 30 may be referred to as "ink-extract-side communication chamber 30" while the communication chamber 50 may be referred to as "air-introduce-side communication chamber 50".)

A communication hole 21 is formed through the partition wall 1*c* which defines a ceiling portion of the communication chamber 30, for communication between the communication chamber 30 and the ink chamber 16. At a lower end of a cylindrical wall 22 which extends from the partition wall 1*c* toward the communication chamber 30 so as to surround the communication hole 21, a thin film member 31 formed of a resin material is provided integrally with the casing 1*a* so as to close the communication hole 21. A communication hole 23 is formed through the partition wall 1*c* which defines a ceiling portion of the communication chamber 50, for communication between the communication chamber 50 and the ink chamber 16. At a lower end of a cylindrical wall 24 which extends from the partition wall 1*c* toward the communication chamber 50 so as to surround the communication hole 23, a thin film member 51 formed of the resin material is provided integrally with the casing 1*a* so as to close the communication hole 23. According to the arrangement described above, the ink is fluid-tightly accommodated in the ink chamber 16 by the casing 1*a* and the lid 1*b* until the thin film members 31, 51 are broken as explained below. The length of extension of the cylindrical wall 24 from the partition wall 1*c* toward the communication chamber 50 is made larger than the length of extension of the cylindrical wall 22 from the partition wall 1*c* toward the communication chamber 30, so that a spacing distance between a break portion 72 of the valve member 52 and the thin film member 51 in the air-introduce-side communication chamber 50 is made smaller than a spacing distance between a break portion 72 of the valve member 32 (which will be described) and the thin film member 31 in the ink-extract-side communication chamber 30.

A sleeve member 25 is disposed so as to protrude from the communication hole 23 into the ink chamber 16. An upper end of the sleeve member 25 is open above the surface of the ink in the ink chamber 16, for thereby guiding the outside air introduced by the air-introducing pipe 13 to an upper portion of the ink chamber 16.

In the communication chambers 30, 50 formed in the casing 1*a*, there are fixedly accommodated valve devices 26, 27, respectively. There will be explained the valve device 26.

The valve device 26 includes a support member 46 which is integrally formed of a rubber-like elastic material and the valve member 32 formed of a resin material. The support member 46 has a generally cylindrical shape and includes a valve seat potion 46*a* at a middle portion of the support member 46 in the axial direction thereof, a bias portion 46*b* located on one of opposite sides of the valve seat portion 46*a* nearer to the ink chamber 16, a tubular portion 35 which extends from the valve seat portion 46*a* toward the other side opposite to the bias portion 46*b*, and an outer cylindrical wall 33 located radially outwardly of the tubular portion 35 with a spacing therebetween and extending in parallel with the tubular portion 35. The valve member 32 is biased by the bias portion 46*b* in a direction in which the valve member 32 abuts on the valve seat portion 46*a*, and is accommodated within the bias portion 46*b*.

The outer cylindrical wall 33 includes a positioning portion 33*a* located on one of its axially opposite ends on the side of the exterior of the casing 1*a* and protruding in a radially outward direction. The outer cylindrical wall 33 has an outside diameter at the other end on the side of the ink chamber 16 smaller than an outside diameter of the positioning portion 33*a*. The communication chamber 30 includes, at its open end, a large-diameter portion having a diameter larger than the other portion (small-diameter portion) thereof, for accommodating the positioning portion 33*a*. A stepped surface 44 is formed at connection between the large-diameter and small-diameter portions.

As shown in an enlarged view which is indicated by an encircled portion in FIG. 2 and which shows a state in which the valve device 26 is fixed in the communication chamber 30, a protrusion 43 is formed on the stepped surface 44 facing the positioning portion 33*a*, and a fixing wall 42 is formed adjacent to the periphery of the opening of the communication chamber 30 so as to axially protrude therefrom. The fixing wall 42 is for fixing the valve device 26 in the communication chamber 30. Described in detail, after the valve device 26 is inserted into the communication chamber 30, the fixing wall 42 is bent by heat while the positioning portion 33*a* is deformed by being pressed onto the protrusion 43. According to this arrangement, the ink is prevented from flowing out of space formed between the outer wall of the valve device 26 and the inner wall of the communication chamber 30.

The valve seat portion 46*a* has an opening 41 formed in its central portion through the thickness thereof in the axial direction. The tubular portion 35 has a guide passage 40 into which the ink-extracting pipe 12 is inserted when the ink cartridge 1 is mounted on the mounting portion 3. The tubular portion 35 is adjacent to the valve seat portion 46*a* with the guide passage 40 held in communication with the opening 41. The valve member 32 which is held in abutting contact with the valve seat portion 46*a* is exposed to an exterior of the ink cartridge 1 through the opening 41 and the guide passage 40, so that the valve member 32 is opposed to the ink-extracting pipe 12 inserted into the guide passage 40. The guide passage 40 is arranged to have an inside diameter smaller than an outside diameter of the ink-extracting pipe 12 such that the inner wall of the tubular portion 35 defining the guide passage 40 closely contacts the inserted ink-extracting pipe 12. The opening 41 has a size which is larger than the inside diameter of the guide passage 40 and the outside diameter of the ink-extracting pipe 12. The inside diameter of the guide passage 40 gradually increases, at one end thereof which is nearer to the exterior of the ink cartridge 1, in a direction away from the opening 41.

The tubular portion 35 and the outer cylindrical wall 33 are spaced apart from each other by an annular groove 34, and the tubular portion 35 is arranged to be elastically deformed in a plane perpendicular to the center axis direction of the guide passage 40. Accordingly, the tubular portion 35 is readily deformed such that its diameter increases in a radially outward direction indicated by arrows "Y" in FIG. 5A as the ink-extracting pipe 12 is inserted into the guide passage 40, and the ink-extracting pipe 12 and the inner wall of the tubular portion 35 defining the guide passage 40 are held in good sealing contact with each other for preventing the ink from leaking therebetween. Thus, the tubular portion 35 functions as a seal for preventing the ink leakage. Even if the ink-extracting pipe 12 is inserted into the guide passage 40 in an inclined state, the deformation of the tubular portion 35 makes the insertion of the ink-extracting pipe 12 possible. As the ink-extracting pipe 12 is inserted into the guide passage 40, the tubular portion 35 is elastically deformed such that its inner wall defining the guide passage 40 is slightly pressed toward the valve member 32. This deformation is absorbed by space within the opening 41 having a large diameter, so that the valve member 32 is prevented from being pressed by the deformed inner wall.

The tubular portion 35 is formed so as to have a length which is smaller than that of the outer cylindrical wall 33, in other words, the lower end of the tubular portion 35 is not flush with or does not reach the lower end of the outer cylindrical wall 33 which is on the side of insertion of the ink-extracting pipe 12. In this arrangement, when a single body of the valve device 26 is placed on a desk or the like separately from other components of the ink cartridge 1, the surface of the desk or the like on which the valve device 26 is placed is not stained with the ink remaining within the tubular portion 35.

The bias portion 46*b* is constituted by including a cylindrical side wall portion 36 which extends from the periphery of the valve seat portion 46*a* toward the ink chamber 16 and an inwardly extending portion 37 which is formed adjacent to the cylindrical side wall portion 36 and which extends radially inwardly so as to abut one end of a cylindrical valve wall 71 of the valve member 32 (which will be described), which one end is located on the side of the ink chamber 16. The inwardly extending portion 37 has a central hole 37*a* formed at its central portion. The bias portion 46*b* biases, by elasticity of the cylindrical side wall portion 36 and the inwardly extending portion 37, the valve member 32 in a direction in which the valve member 32 abuts on the valve seat portion 46*a*. In a normal state, the valve member 32 is held in abutting contact with the valve seat portion 46*a*. When the valve member 32 is pushed up toward the ink chamber 16 upon insertion of the ink-extracting member 12 into the guide passage 40, the cylindrical side wall portion 36 is stretched and the inwardly extending portion 37 is inclined as shown in FIG. 5B, to thereby form a clearance between the valve member 32 and the valve seat portion 46*a* for an ink flow.

The thickness t1 (FIG. 5A) of the cylindrical side wall portion 36 as measured in the radial direction (i.e., as measured in a direction perpendicular to the axial direction of the support member 46) is made smaller than the thickness t2 (FIG. 5A) of the valve seat portion 46*a* as measured in a direction in which the ink-extracting pipe 12 is inserted into the guide passage 40, and also smaller than the thickness of the outer cylindrical wall 33 as measured in the radial direction thereof. According to this arrangement, when the valve member 32 is pushed up by the ink-extracting pipe 12 toward the ink chamber 16, the bias portion 46*b* undergoes large deformation, as compared with the valve seat portion 46*a* and the outer cylindrical wall 33, so as to form the clearance between the valve member 32 and the valve seat portion 46*a*.

Referring next to FIG. 3, there will be explained the valve member 32.

The valve member 32 includes a bottom portion 70 which abuts on the valve seat portion 46*a* of the support member 46, the cylindrical valve wall 71 which extends from the periphery of the bottom portion 70 toward the ink chamber 16, and the break portion 72 which is formed at a substantially central portion of the bottom portion 70 so as to protrude toward the ink chamber 16 farther than the cylindrical valve wall 71 and whose top end that is remote from the bottom portion 70 is pointed.

The bottom portion 70 has, on one of its opposite surfaces facing the valve seat portion 46*a*, an annular protruding portion 39 (FIG. 2) which protrudes toward the valve seat portion 46*a* and which is formed at a position located radially inwardly of communication passages 38 (which will be described) and radially outwardly of the opening 41 of the valve seat portion 46*a*. In a state in which the valve member 32 is accommodated within the support member 46, the cylindrical valve wall 71 of the valve member 32 is held in close contact with and pressed against the lower surface of the inwardly extending portion 37 of the bias portion 46*b*, whereby the annular protruding portion 39 of the valve member 32 closely contacts the upper surface of the valve seat 46*a* by elastically deforming the same 46*a*.

The bottom portion 70 of the valve member 32 is formed with a plurality of communication passages 38 which are located radially outwardly of the protruding portion 39 and radially inwardly of the cylindrical valve wall 71. By the communication passage 38*b*, the upper portion of the valve member 32 on the side of the ink chamber 16 and the lower portion of the valve member 32 on the side of the valve seat portion 46*a* communicate with each other. While, in the first exemplary embodiment, eight communication passages 38 are formed, the number of the communication passages 38 is not particularly limited.

The break portion 72 of the valve member 32 has four plate members 73*a*, 73*b*, 73*c*, 73*d* which are disposed at a substantially central portion of the bottom portion 70 and which are assembled in a substantially cross, and four grooves 77 each of which is defined by adjacent two of the plate members 73*a*-73*d* and each of which extends in a direction parallel to the center axis direction of the valve member 32. The plate members 73*a*-73*d* respectively have first inclined portions 74*a*-74*d* and second inclined portions 75*a*-75*d* formed adjacent to the respective first inclined portions 74*a*-74*d*. The first inclined portions 74*a*-74*d* extend from the tip 76 of the break portion 72 toward the bottom portion 70 so as to be inclined with respect to the center axis of the valve member 32 at a first angle (e.g., generally 45 degrees in the first embodiment) while the second inclined portions 75*a*-75*d* extend from the respective first inclined portions 74*a*-74*d* toward the bottom portion 70 so as to be inclined with respect to the center axis at a second degree which is smaller than the first angle (e.g., generally 10 degrees in the first embodiment). The break portion 72 protrudes through the central opening 37*a* of the inwardly extending portion 37, so that the tip 76 of the break portion 72 is opposed to the thin film member 31 with a spacing therebetween.

Figure 4:
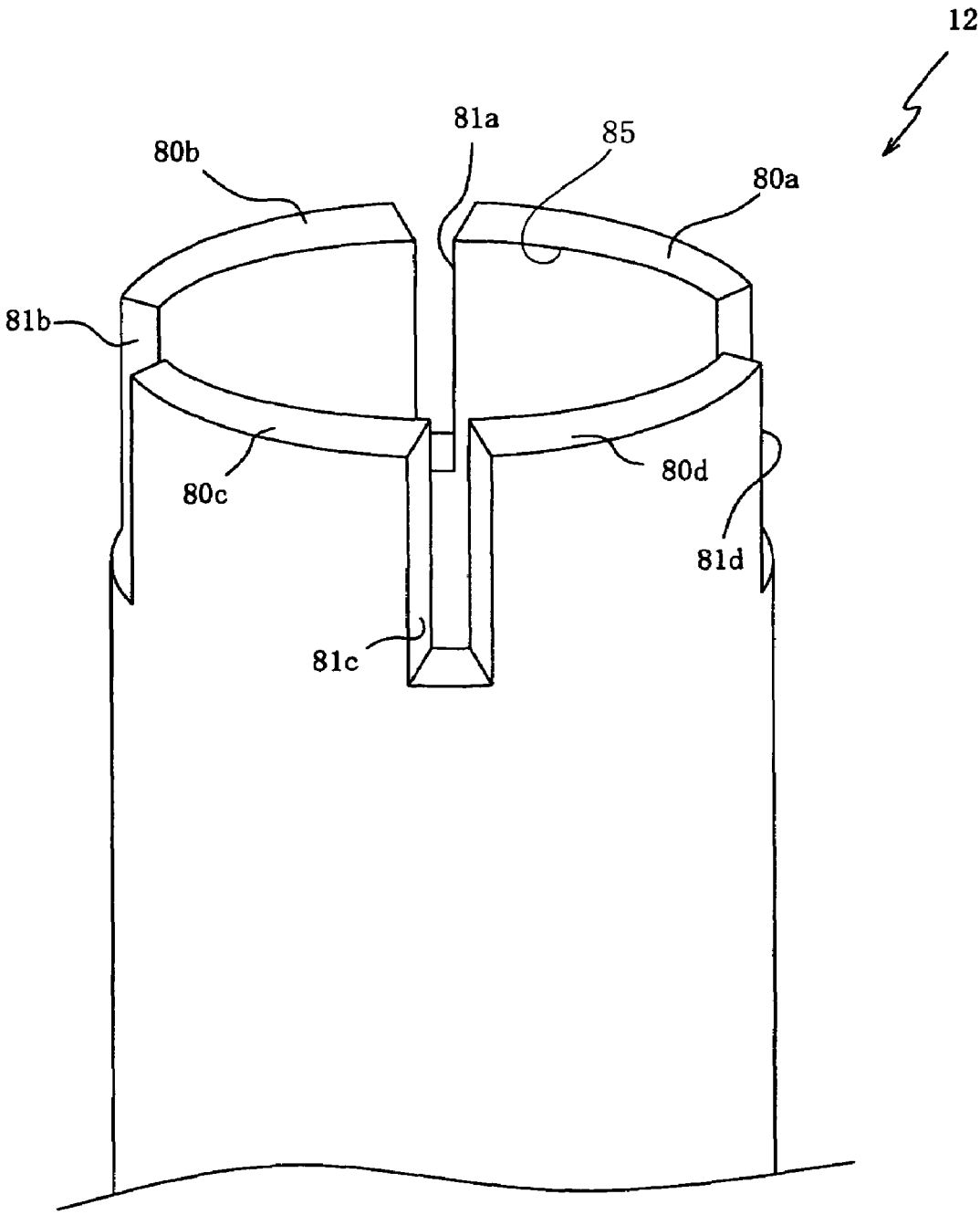
FIG. 4 is a perspective view showing a top end portion of an ink-extracting pipe constructed according to the first embodiment of the invention.

Next, there will be explained the ink-extracting pipe 12 and the air-introducing pipe 13. The perspective view of FIG. 4 shows the end portion of the ink-extracting pipe 12 which is to be located on the side of the valve member 32. Since the ink-extracting pipe 12 and the air-introducing pipe 13 are the same in shape and dimension, an explanation will be made with respect to the ink-extracting pipe 12 and an explanation of the air-introducing pipe 13 is dispensed with.

The ink-extracting pipe 12 is formed of a resin material and has an ink-extract passage 92 as an inner passage formed therein an end opening 85 which is open in its end face (upper end face) that abuts on the lower surface of the valve member 32 and to which the ink-extract passage 92 is open. The end face which is to abut on the lower surface of the valve member 32 is constituted by a plurality of segments 80*a*-80*d* (hereinafter referred to as "end faces 80*a*-80*d*) which are generally flat. The ink-extracting pipe 12 has a plurality of communication openings 81*a*, 81*b*, 81*c*, 81*d* as ink-extract communication openings, each of which is a cutout formed at the end of the peripheral wall of the ink-extracting pipe 12 through the thickness of the peripheral wall in the radial direction. From another viewpoint, the communication openings 81*a*-81*d* constitute portions of the periphery of the end opening 85. The ink-extract passage 92 of the ink-extracting pipe 12 communicates with the exterior of the pipe 12 through the communication openings 81*a*-81*d* which are equiangularly spaced apart from each other in the circumferential direction of the ink-extracting pipe 12. The ink-extract passage 92 of the ink-extracting pipe 12 is open in directions substantially perpendicular to the center axis of the ink-extracting pipe 12 through the communication openings 81*a*-81*d*. While, in the first embodiment, four ink-extract communication openings 81*a*-81*d* are formed, the number of the communication openings 81*a*-81*d* are not particularly limited.

Since the end faces 80*a*-80*d* of the ink-extracting pipe 12 are generally flat, the ink-extracting pipe 12 can substantially uniformly press the lower surface of the valve member 32 on which the ink-extracting pipe 12 abuts, whereby the valve member 32 is prevented from being inclined, resulting in a constantly stable ink flow. The ink-extract communication openings 81*a*-81*d* are formed by cutting the end face of the ink-extracting pipe 12 which abuts on the lower surface of the valve member 32, so that the ink flow is established with high reliability even when the ink-extracting pipe 12 is held in abutting contact with the valve member 32.

Further, the arrangement described above prevents the user from being injured by contacting the ink-extracting pipe 12 even if the ink-extracting pipe 12 is disposed so as to protrude from the mounting portion 3 since the top end of the and pushed up toward the ink chamber 16 against the elasticity of the bias portion 46*b*. When the vale member 32 is further pushed up, the tip 76 of the break portion 72 is brought into abutting contact with the thin film member 31 and subsequently breaks the same 31. As a result, the ink in the ink chamber 16 is supplied into the communication chamber 30, subsequently into the inside of the valve device 26 through the central opening 37*a* at the upper end of the same 26, and then flows between the lower surface of the valve member 32 and the upper surface of the valve seat portion 46*a* via the communication passages 38, enters the ink-extract passage 92 of the ink-extracting pipe 12 (as shown in arrows "B" in FIG. 5A) via the ink-extract communication openings 81*a*-81*d*, and is finally supplied to the recording head 7. The operation of the break portion 72 for breaking the thin film member 31 will be described in detail.

At the same time when the ink-extracting pipe 12 enters the guide passage 40, the air-introducing pipe 13 enters the valve device 27 which is accommodated in the communication chamber 50, thereby pushing up the valve member 52 of the valve device 27. Since the spacing distance between the break portion 72 of the valve member 52 and the thin film member 51 in the communication chamber 50 (hereinafter referred to as "air-introduce-side thin film member 51) is smaller than the spacing distance between the break portion 72 of the valve member 32 and the thin film member 31 in the communication chamber 30 (hereinafter referred to as "ink-extract-side thin film member 31") as described above, the air-introduce-side thin film ink-extracting pipe 12 of the present invention is not pointed unlike the conventional ink-extracting member.

The valve device 27 disposed in the air-introduce-side communication chamber 50 uses components which are the same as used in the valve device 26 and which are similarly assembled, and the dimensional and positional relationship between the air-introducing pipe 13 and the valve device 27 is the same as that between the ink-extracting pipe 12 and the valve device 26. In view of the above, a detailed explanation of the valve device 27 is not given. Similarly, since the valve member 52 of the valve device 27 is identical in structure and function with the valve member 32 of the valve device 26, a detailed explanation of the valve member 52 is dispensed with.

Figure 5A:
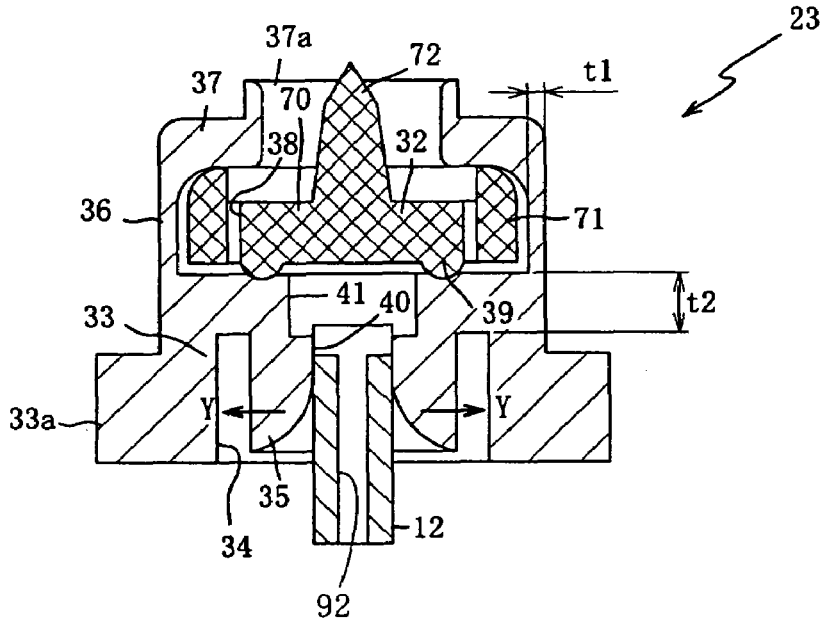
FIG. 5A shows a state in which the ink-extracting pipe is inserted into a valve device of the ink cartridge of FIG. 2
Figure 5B:
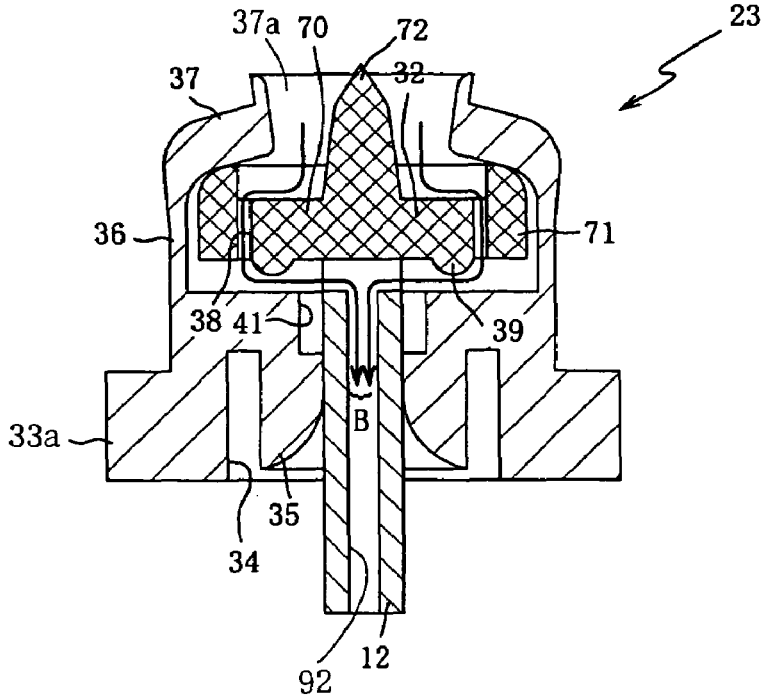
FIG. 5B shows a state in which the ink-extracting pipe places the valve device in an open state.

Referring next to FIGS. 5A and 5B, there will be explained an operation of the valve device 26 when the ink cartridge 1 is mounted on the ink-jet recording apparatus 2.

Upon mounting the ink cartridge 1 on the mounting portion 3, the ink-extracting pipe 12 enters the guide passage 40 of the tubular portion 35 as shown in FIG. 5A, so that the ink-extracting pipe 12 comes into close contact at its outer surface with the inner wall of the tubular portion 35 defining the guide passage 40, to thereby inhibit the ink from flowing out of the ink cartridge 1. When the valve member 32 is pushed up toward the ink chamber 16 as shown in FIG. 5B by abutting contact of the ink-extracting pipe 12 with the valve member 32, the valve member 32 is separated from the valve seat portion 46*a* member 51 is broken before the ink-extract-side thin film member 31 is broken. The ink cartridge 1 is generally enclosed within a sealing wrapper or container under a reduced pressure for keeping the ink in the ink cartridge 1 at a deaerated or degassed state, and the inside of the ink chamber 16 is also kept under the reduced pressure. By breaking the air-introduce-side thin film member 51 before breaking the ink-extract-side thin film member 31 as described above, the ink-extract-side thin film member 31 is broken after the air has been introduced into the upper portion of the ink chamber 16 through the sleeve member 25, so that the ink can be supplied into the ink-extracting pipe 12 with high reliability. If the ink-extract-side thin film member 31 is broken earlier than the air-introduce-side thin film member 51, the air enters the ink-extract passage 92 of the ink-extracting pipe 12, undesirably inhibiting smooth supply of the ink.

When the ink cartridge 1 is removed from the mounting portion 3 for uninstalling the ink cartridge 1 from the ink-jet recording apparatus 2, the ink-extracting pipe 12 and the air-introducing pipe 13 are removed from the respective valve members 32, 52, and the valve members 32, 52 are brought into abutting contact with the respective valve seat portions 46*a* owing to the biasing force of the respective bias portions 46*b*. In this instance, since the annular protruding portion 39 is formed on the lower surface of the valve member 32 facing the valve seat portion 46*a*, the ink chamber 16 is fluid-tightly sealed with high reliability, thereby preventing ink leakage. Since an atmospheric pressure does not act on the ink remaining in the vicinity of the opening 41 of the valve seat portion 46*a* of the valve device 26 owing to closure of the opening 41 at its upper end by the valve member 32 and the inside diameter of the guide passage 40 is relatively small (e.g., about 2 mm), a meniscus is formed in the vicinity of the opening 41, so that the ink remaining in the vicinity of the opening 41 is prevented from dripping to the outside of the ink cartridge 1.

Referring next to FIG. 6, there will be explained how the ink-extract-side thin film member 31 is broken by the break portion 72. Since the air-introduce-side thin film member 51 is broken in a manner similar to that in which the ink-extract-side thin film member 31 is broken, a detailed explanation of which is dispensed with.

Figures 2, 6A:
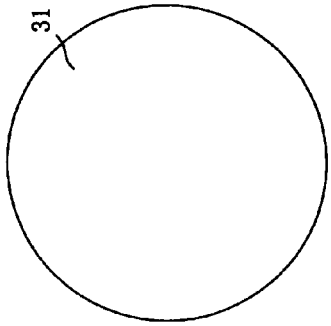

FIG. 6A-1 shows a state in which the tip 76 of the break portion 72 abuts on the thin film member 31 when the valve member 32 is pushed up toward the ink chamber 16. In this state, the thin film member 31 is not yet broken as shown in FIG. 6A-2.

Figures 2, 6B:
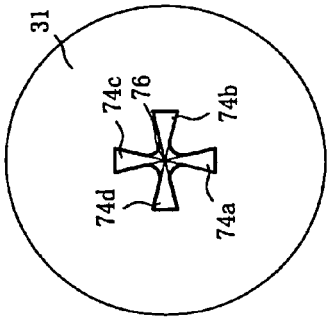

FIG. 6B-1 shows a state in which the break portion 72 is further pushed up and the thin film member 31 is broken by the first inclined portions 74-74*d* of the break portion 72. The thin film member 31 is held in close contact with the first inclined portions 74*a*-74*d* while substantially following the shape of the break portion 72. In this state, the grooves 77 are closed, so that substantially no ink passages are formed as shown in FIG. 6B-2.

Figures 2, 6C:
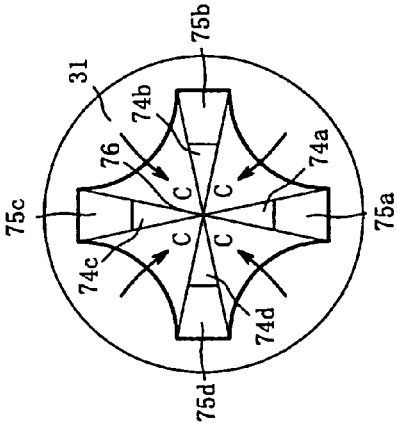
Figures 1, 6A:
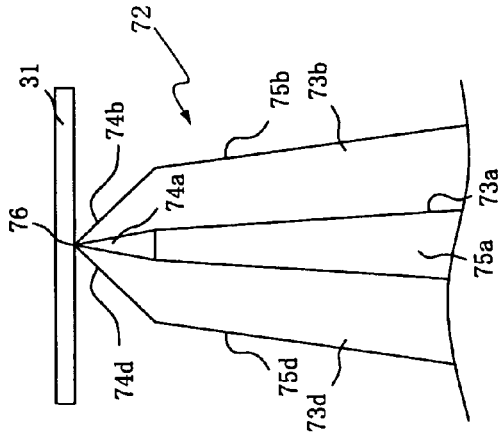
Figures 1, 6B:
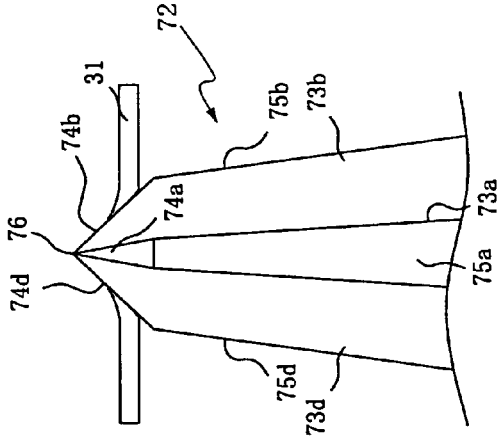
Figures 1, 6C:
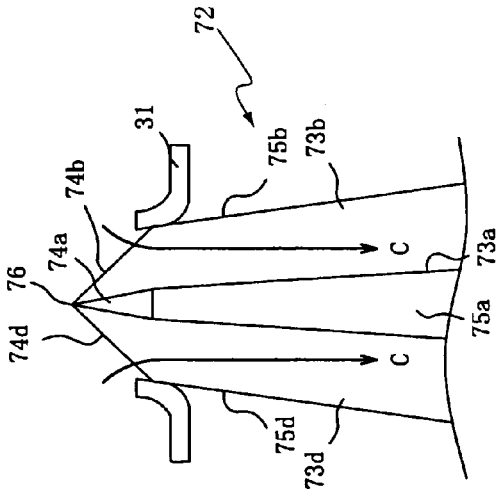

FIG. 6C-1 shows a state in which the mounting of the ink cartridge 1 on the ink-jet recording apparatus 2 is completed. In this state shown in FIG. 6C-1, the thin film member 31 is broken through by the second inclined portions 75*a*-75*d* of the break portion 72, whereby the broken portion of the thin film member 31 is enlarged or broadened. Accordingly, the grooves 77 each of which is defined by adjacent two of the plate members 73*a*-73*d* are opened, thereby forming respective ink passages indicated by "C" in FIGS. 6C-1 and 6C-2 for communication between the ink chamber 16 and the ink-extracting pipe 12. There are formed four ink passages C which are arranged along the periphery of the break portion 72 with an equiangularly spaced-apart relationship from each other, so that the ink can be generally uniformly supplied toward the ink-extracting pipe 12.

When the second inclined portions 75*a*-75*d* break through the thin film member 31, the angle of bend or curve of the broken portion of the thin film member 31 changes from that when the first inclined portions 74*a*-74*d* have broken the same 31. Accordingly, the broken portion of the thin film member 31 separates from the grooves 77 each defined between the adjacent two of the plat members 73*a*-73*d*, so that the ink passages C are formed as described above. Further, in this instance, the degree of adhesion with which the thin film member 31 contacts the plate members 73*a*-73*d* is decreased, whereby the break portion 72 and the thin film member 31 can be separated from each other owing to the biasing force of the bias portion 46*b* when the ink cartridge 1 is removed from the mounting portion 3.

As explained above, in the ink cartridge 1 constructed according to the first embodiment, the valve member 32 having the break portion 72 whose tip is pointed for breaking the thin film member 31 is held by the support member 46 which is fixedly accommodated in the communication chamber 30. Accordingly, when the ink cartridge 1 is installed on the ink-jet recording apparatus 2, the valve member 32 is pushed up toward the ink chamber 16 by the ink-extracting pipe 12 so that the valve member 32 is placed in its open state, and the thin film member 31 is broken, permitting the ink flow from the ink chamber 16 toward the ink-extracting pipe 12, as indicated by the arrows B and C. Thus, in the present arrangement, there is no need to make the top end of the ink-extracting pipe 12 point-shaped, thereby preventing the user from being injured by the ink-extracting pipe 12 and assuring improved safety. Moreover, since the valve member 52 and the support member 46 of the valve device 27 provided in the air-introduce-side communication chamber 50 are similarly formed, assuring further improved safety.

Because the top end of the ink-extracting pipe 12 need not be pointed or sharpened, it is not required to additionally provide any protective device for protecting or covering the ink-extracting pipe 12 to prevent the same 12 from being exposed, avoiding an increase in the size of the ink-jet recording apparatus 2. Further, since the number of the required components is reduced, the cost of manufacture of the ink-jet recording apparatus 2 is prevented from being pushed up.

In the illustrated first embodiment, the size of the valve devices 26, 27 is made slightly smaller than the size of the communication chambers 30, 50, and the valve devices 26, 27 are fixedly accommodated within the respective communication chambers 30, 50 by being pressed by the fixing wall 42 serving as a pressing member. The size of the valve devices 26, 27 may be made slightly larger than the size of the communication chambers 30, 50, and the valve devices 26, 27 may be press-fitted into the respective communication chambers 30, 50 for fixation.

In the illustrated first embodiment, the communication openings 81*a*-81*d* of the ink-extracting pipe 12 and the air-introducing pipe 13 are formed by cutting an end of the peripheral wall of each pipe 12, 13, which end is to be located near to the ink chamber 16. The communication openings 81*a*-81*d* may be in the form of through-holes formed through the thickness of the peripheral wall of each pipe 12, 13 for communication between the inside and outside of each pipe 12, 13.

In the illustrated first embodiment, the valve member 32 includes the break portion 72 whose tip is pointed, the bottom portion 70, and the cylindrical valve wall 71 which are formed integrally with one another. A break portion for breaking a thin film member and a valve which permits and inhibits communication between the ink-chamber side of the ink cartridge 1 and the exterior of the casing 1*a* of the ink cartridge 1 may be provided independently from each other.

Figure 7:
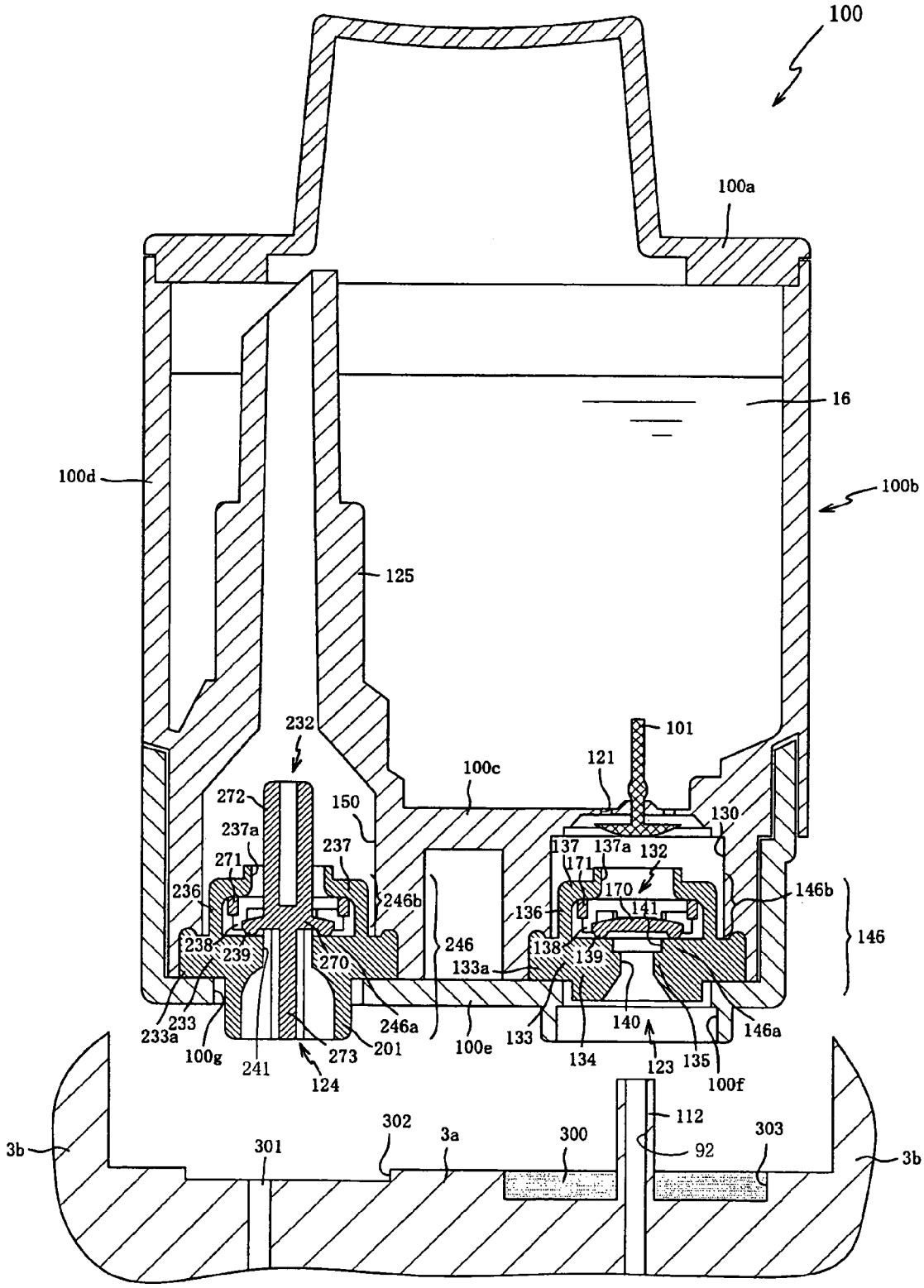
FIG. 7 is a cross sectional view showing an ink cartridge constructed according to a second embodiment of the invention.
Figure 8:
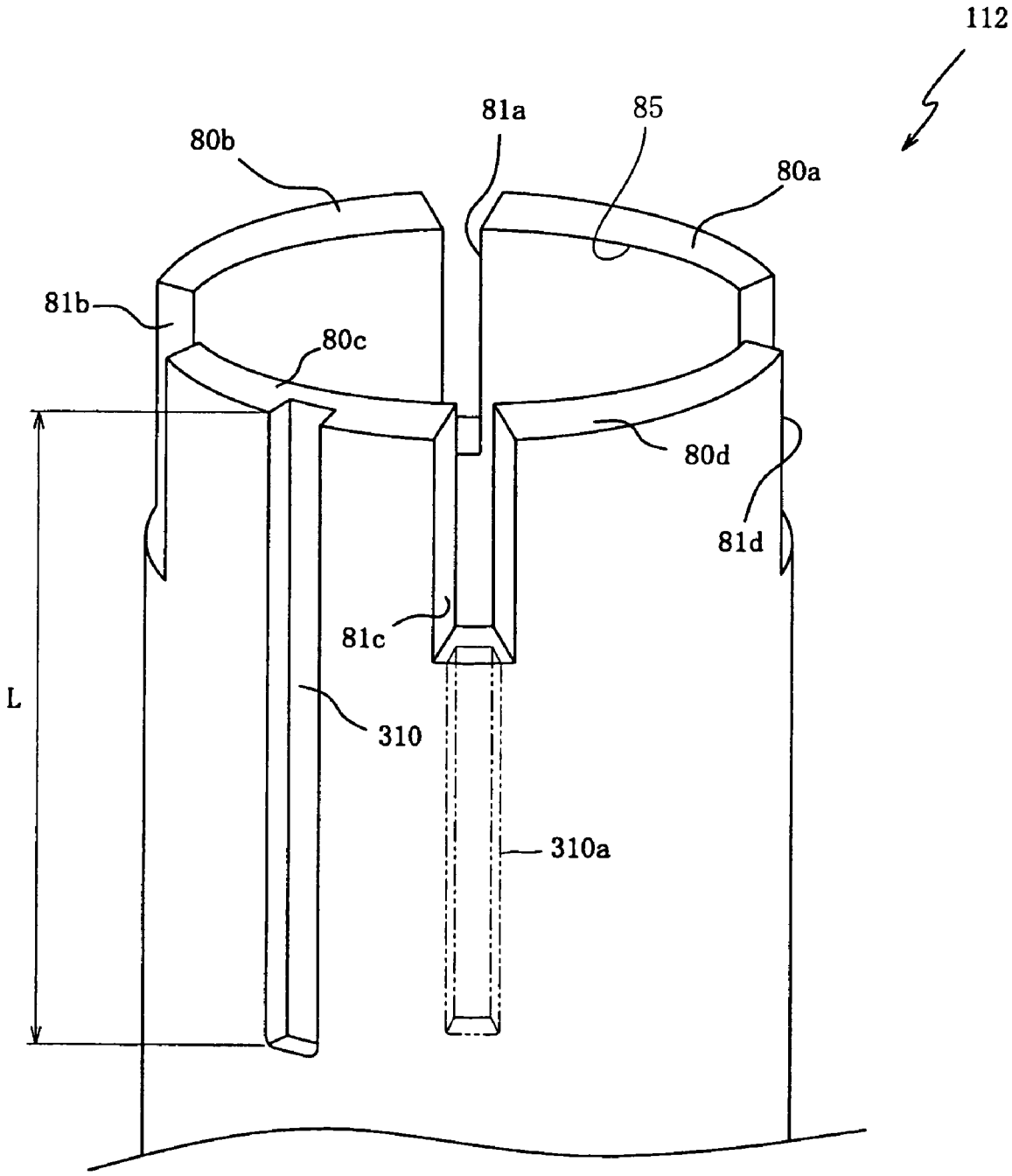
FIG. 8 is a perspective view showing a top end portion of an ink-extracting pipe constructed according to the second embodiment of the invention.
Figure 9A:
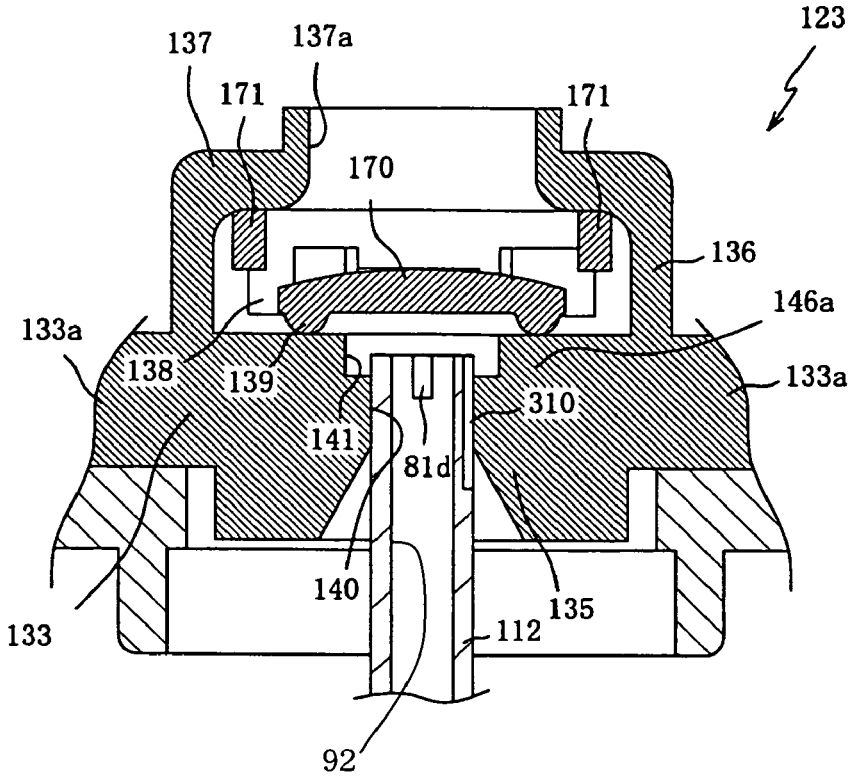
FIGS. 9A and 9B are cross sectional views showing a state in which the ink-extracting pipe is inserted into a valve device of the ink cartridge of FIG. 7.
Figure 9B:
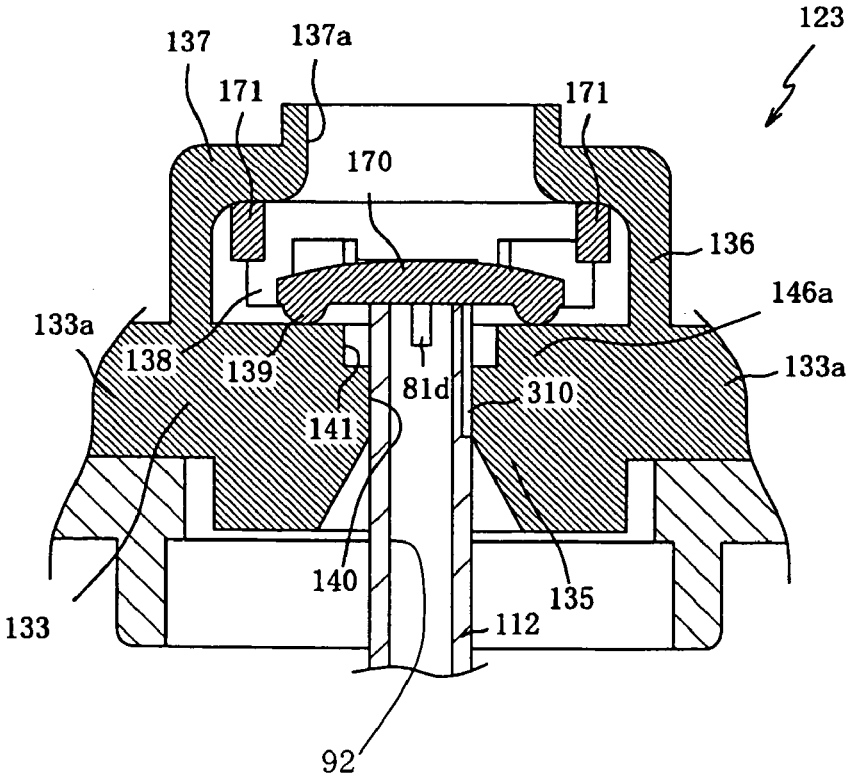

There will be next explained an ink cartridge 100 of a second embodiment of the present invention by referring to FIGS. 7-9. FIG. 7 is a cross-sectional view of the ink cartridge 100, FIG. 8 is a perspective view showing a top end portion of an ink-extracting pipe 112 of the second embodiment, and FIGS. 9A, 9B are views each showing a state in which the ink-extracting pipe 112 is inserted into a valve device 123 of the ink cartridge 100. In the second embodiment, the same reference numerals as used in the first embodiment are used to identify the corresponding components, and a detailed explanation of which is dispensed with.

As shown in FIG. 7, the ink cartridge 100 of the second embodiment includes: a casing 100*b* which has a bottom wall 100*c* and a circumferential wall 100*d* that define the ink chamber 16 and which is open upwards; a lid 100*a* which covers the upper opening of the casing 100*b*; and a cap 10*e* which caps the bottom wall 100*c*. The lid 100*a* and the cap 100*e* are welded or thermally bonded to the casing 100*b* to provide the ink cartridge 100. The cap member 10*e* is formed with two end holes 100*f*, 100*g* which are exposed to the atmosphere and through which respective valve devices 123, 124 that will be described are exposed to the exterior of the ink cartridge 100.

Below the bottom wall 100*c*, there are formed an ink-extract-side communication chamber 130 which is open for extracting the ink in the ink chamber 16 to the exterior of the ink cartridge 100 and an air-introduce-side communication chamber 150 which is open for introducing the outside air into the ink chamber 16. The ink-extract-side communication chamber 130 and the air-introduce-side communication chamber 150 are respectively defined by interior spaces of two cylindrical walls which protrude from the lower surface of the bottom wall 100*c* and which are formed of a resin material integrally with the bottom wall 100*c*.

The bottom wall 100*c* is formed with a plurality of communication holes 121 through which the ink-extract-side communication chamber 130 and the ink chamber 16 communicate with each other. The bottom wall 100*c* is equipped with a generally umbrella-like check valve 101 for opening and closing the plurality of communication holes 121. The check valve 101 consists of a generally disc-like elastic film part disposed below the communication holes 121 and a shaft part for supporting the elastic film part at one of its opposite ends. The elastic film part and the shaft part are formed of a synthetic resin material integrally with each other. The shaft part of the check valve 101 is inserted through a through-hole formed in the bottom wall 100*c* so as to be slidably movable in an upward and a downward direction. In a normal state, the elastic film part of the check valve 101 is located so as to be spaced apart from the communication holes 121, thereby permitting a flow of the ink from the ink chamber 16 toward the communication chamber 130. When a flow of the ink from the ink-extracting pipe 112 toward the ink chamber 16 is generated, the elastic film part of the check valve 101 is moved upward (i.e., toward the ink chamber 16) to close the communication openings 121 for inhibiting the ink flow. As explained above, the ink cartridge 100 is enclosed in the sealing wrapper or container under the reduced pressure. If the valve device 123 accommodated in the ink-extract-side communication chamber 130 is placed in its open state earlier than the valve device 124 accommodated in the air-introduce-side communication chamber 150 upon mounting the ink cartridge 100 on the ink-jet recording apparatus 2, there will be generated the ink flow from the ink-extracting pipe 112 toward the ink chamber 16. The check valve 101 inhibits that ink flow.

On the bottom wall 100*c*, there is formed a hollow sleeve member 125 which extends from the bottom wall 100*c* in an upward direction toward the upper opening of the casing 100*b* and which is formed integrally with the bottom wall 100*c*. The sleeve member 125 has an inside passage which communicates with the air-introduce-side communication chamber 150. One of opposite ends of the inside passage of the sleeve member 125 remote from the communication chamber 150 is open above the surface of the ink in the ink chamber 16. The sleeve member 125 is formed integrally with the cylindrical wall defining the communication chamber 150, and the bottom wall 100*c* is formed integrally with the integrally formed sleeve member 125 and the cylindrical wall of the communication chamber 150. The other of the opposite ends of the inside passage of the sleeve member 125 nearer to the communication chamber 150 has a diameter which gradually increases in the downward direction toward the communication chamber 150.

The valve device 123 is accommodated in the cylindrical wall defining the ink-extract-side communication chamber 130 while the valve device 124 is accommodated in the cylindrical wall defining the air-introduce-side communication chamber 150. The valve devices 123, 124 will be explained.

Like the valve device 32 in the illustrated first embodiment, the valve device 123 of the second embodiment has a support portion 146 which is integrally formed by a rubber-like elastic member, and a valve member 132 formed of a resin material. Like the support member 46 in the illustrated first embodiment, the support member 146 is constituted by including a valve seat portion 146*a*, a bias portion 146*b*, a tubular portion 135, an outer cylindrical wall 133, and a positioning portion 133*a* located radially outwardly of the outer cylindrical wall 133, which are formed integrally with one another. Unlike the outer cylindrical wall 33 in the illustrated first embodiment, the outer cylindrical wall 133 is not longer than the tubular portion 135, and the valve seat portion 146*a* and the positioning portion 133*a* are formed on the substantially same plane. The valve seat portion 146*a* has an opening 141, the tubular portion 135 has a guide passage 140, and the bias portion 146*b* has a side wall portion 136 and an inwardly extending portion 137 in which a hole 137*a* is formed. Since the operation of each component of the support member 146 is the same as that of each component of the support member 46 in the illustrated first embodiment, a detailed explanation of which is not given.

Like the valve member 32 in the illustrated first embodiment, the valve member 132 has a bottom portion 170 which abuts on the valve seat portion 146*a* of the support member 146, a cylindrical valve wall 171 which extends from the periphery of the bottom portion 170 toward the ink chamber 16. The bottom portion 170 has a protruding portion 139 formed on one of its opposite surfaces facing the valve seat portion 46*a*. The valve member further has a plurality of communication passages 138 each of which is located radially outwardly of the protruding portion 139 and extends into the cylindrical valve wall 171. The plurality of communication passages 138 are formed so as to be spaced apart from each other with a constant spacing distance in the circumferential direction of the bottom portion 170.

The valve device 124 accommodated in the air-introduce-side communication chamber 150 has a support member 246 which is integrally formed by a rubber-like elastic member, and a valve device 232 formed of a resin material. The support member 246 of the valve device 124 has a valve seat portion 246*a*, a bias portion 246*b*, an outer cylindrical wall 233, and a positioning portion 233*a* located radially outwardly of the outer cylindrical wall 233, which are formed integrally with one another. The valve seat portion 246*a* has an opening 241, and the bias portion 246*b* has a side wall portion 236 and an inwardly extending portion 237 in which a hole 237*a* is formed. Each component of the support member 246 has the same structure as that of each component of the support member 146 and operates similarly. The support member 246 has, in place of the tubular portion 135 of the support portion 146, a cylindrical sealing portion 201 having an inner diameter sufficiently larger than that of the tubular portion 135.

The valve member 232 has a bottom portion 270, a cylindrical valve wall 271, communication passages 238, and a protruding portion 239, which are configured similarly to the corresponding components of the valve member 132. The valve member 232 further has: a projecting portion 272 which is formed at a generally central portion of the upper surface of the bottom portion 270 and which projects toward the ink chamber 16 farther than the cylindrical valve wall 271; and a shaft-shaped operating member 273 which is formed at a generally central portion of the lower surface of the bottom portion 270 and which extends toward the mounting portion 3 of the ink-jet recording apparatus 2. When the ink cartridge 100 is properly mounted on the mounting portion 3 and the valve member 232 is moved upward from the valve seat portion 246*a*, the upper end of the projecting portion 272 is positioned such that it is spaced apart from the lower end of the inside passage of the sleeve member 125, so as to assure communication between the ink chamber 16 and the opening 241 of the valve seat portion 246*a*.

As in the illustrated first embodiment, the mounting portion 3 has the base portion 3*a* and the guide portions 3*b* respectively extending from the opposite ends of the base portion 3*a*. The ink-extracting pipe 112 is disposed on the base portion 3*a* so as to protrude therefrom for extracting the ink stored in the ink cartridge 100. In the base portion 3*a*, a recess 303 is formed in the vicinity of the ink-extracting pipe 112, and a porous member 300 fills the recess 303. The porous member 300 is capable of absorbing the ink and has flexibility. The size of the porous member 300 is made larger than that of the end hole 100*f* formed in the cap 10*e*. In the ink-jet recording apparatus of the second embodiment, the air-introducing pipe 13 provided in the apparatus of the first embodiment is not provided. Instead, there is formed an air-introducing passage 301 in the base portion 3*b* at a position which is to be located inward of the sealing portion 201 and at which the air-introducing passage 301 is not to be closed by the lower end of the operating member 273. In the base portion 3*a*, a recess 302 is formed so as to surround the air-introducing passage 301. The recess 302 has a size larger than the outer dimension of the sealing portion 201.

Referring next to FIG. 8, the ink-extracting pipe 112 of the second embodiment will be explained. The ink-extracting pipe 112 has an-discharge passage 310 formed in its peripheral wall for discharging air existing between the valve member 132 and the ink-extracting pipe 112 (i.e., air in the guide passage 140 and the opening 141), out into the exterior of the ink cartridge 100, when the ink-extracting pipe 112 is inserted into the guide passage 140. The air-discharge passage 310 is constituted by a groove which generally linearly extends along the peripheral wall of the ink-extracting pipe 112 in the axial direction thereof. The air-discharge passage 310 is located generally middle between the ink-extract communication openings 81*b*, 81*c* as seen in the circumferential direction of the ink-extracting pipe 112 and is generally parallel with respect to the ink-extract communication openings 81*a*-81*d*. In other words, the ink-extract communication openings 81*a*-81*d* and the air-discharge passage 310 are formed so as not to be connected to each other on the peripheral wall of the ink-extracting pipe 112. There may be formed an air-discharge passage 310*a* which extends from one of the communication openings 81*a*-81*d*, as shown in two-dot chain line in FIG. 8. In the present embodiment, the air-discharge passage 310 extends from the end face 80*c* toward the mounting portion 3 with a length "L" as seen in the axial direction of the ink-extracting pipe 112.

Referring to FIGS. 9A and 9B, the length L of the air-discharge passage 310 will be explained. Upon starting the mounting of the ink cartridge 100 on the mounting portion 3, the ink-extracting pipe 112 is inserted into the guide passage 140 while deforming the tubular portion 135 such that its diameter increases, as in the illustrated first embodiment. In this instance, the air in the guide passage 140 is compressed by an amount corresponding to the volume of the ink-extracting pipe 112 inserted into the guide passage 140. The compressed air is discharged out into the exterior of the ink cartridge 100 through the air-discharge passage 310.

In a state shown in FIG. 9A in which the top end portion of the ink-extracting pipe 112 reaches and enters the opening 141, the opening 141 is held in communication with the exterior of the ink cartridge 100 through the air-discharge passage 310. Accordingly, the air in the opening 141 can be discharged out into the exterior of the ink cartridge 100 through the air-discharge passage 310 even when the air-extracting pipe 112 is further inserted into the opening 141.

In a state shown in FIG. 9B in which the ink-extracting pipe 112 abuts at the end faces 80*a*-80*d* thereof on the bottom portion 170 of the valve member 132, one of opposite ends of the air-discharge passage 310 which is located nearer to the mounting portion 3 is brought into contact with and covered by the inner wall of the tubular portion 135 defining the guide passage 140, thereby shutting off communication with the exterior of the ink cartridge 100. In this respect, the tubular portion 135 functions as a seal. When the ink-extracting pipe 112 further enters the opening 141, the valve member 132 is pushed up by the ink-extracting pipe 112, permitting an ink flow from the ink chamber 16 toward the ink-extracting pipe 112. In this instance, since the communication with the exterior of the ink cartridge 100 through the air-discharge passage 310 is shut off as described above, the ink can be prevented from leaking through the air-discharge passage 310.

Thus, the length L of the air-discharge passage 310 is determined: such that the air-discharge passage 310 is held in communication with the exterior of the ink cartridge 100 for discharging the air between the valve member 132 and the ink-extracting pipe 112, out into the exterior of the ink cartridge 100, until the ink-extracting pipe 112 inserted into the guide passage 140 reaches a position where the pipe 112 substantially abuts on the valve member 132; and such that the communication with the exterior of the ink cartridge 100 through the air-discharge passage 310 is shut off by covering the end of the air-discharge passage 310 located on the side of the mounting portion 3 with the inner wall of the tubular portion 135 defining the guide passage 140, when the ink-extract passage 92 of the ink-extracting pipe 112 is brought into communication with the interior of the ink cartridge 100 for permitting extraction of the ink therefrom.

When the ink cartridge 100 is mounted on the mounting portion 3, the lower end of the cylindrical wall defining the end hole 100*f* is arranged to contact the porous member 300 (FIG. 7). Even if the ink leaks from the valve device 123 or the ink adhering to the ink-extracting pipe 112 drips when the ink cartridge 100 is repeatedly mounted on and removed from the mounting portion 3, the ink is absorbed by the porous member 300, minimizing a risk of stain by the ink.

On the air-introduce side of the ink cartridge 100, when the ink cartridge 100 is mounted on the mounting portion 3, the sealing portion 201 is brought into abutting contact with respect to the recess 302 of the base portion 3*a* while being elastically deformed, so that the inner space of the sealing portion 201 is air-tightly closed so as to be isolated from the outer space thereof. In this instance, the operating member 273 abuts on the bottom surface of the recess 302 and pushes up the valve member 232, permitting an air flow from the air-introducing passage 301 to the ink chamber 16.

In the second embodiment, when the ink cartridge 100 is installed on the ink-jet recording apparatus, the air existing in the guide passage 140 and the opening 141 can be discharged out into the exterior of the ink cartridge 100 through the air-discharge passage 310 formed in the peripheral wall of the ink-extracting pipe 112. This arrangement inhibits the air from flowing into the ink-extract passage 92 of the ink-extracting pipe 112. Accordingly, it is possible to prevent undesirable ink ejection failure generated when the ink is not properly supplied due to the air which would otherwise flow into the ink-extract passage 92, assuring good recording.

Figure 10:
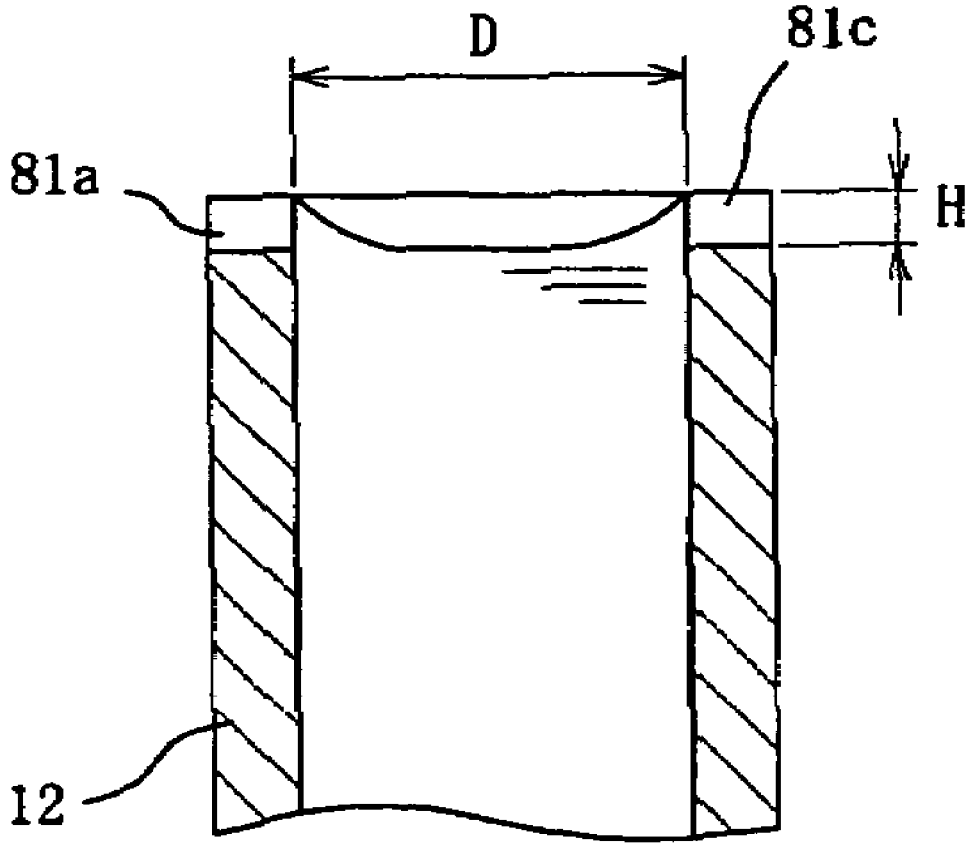
FIG. 10 is a cross sectional view showing a top end portion of the ink-extracting pipe.

In the illustrated first and second embodiments, it is preferable that the ink-extract communication openings 81*a*-81*d* of each ink-extracting pipe 12, 112 have a size, in particular a depth determined such that the ink in the ink-extracting pipe 12, 112 substantially reaches the end faces 81*a*-81*d* thereof owing to surface tension, as shown in FIG. 10.

Suppose that the ink-extract communication openings 81*a*-81*d* have a size in which a distance or depth as measured from the upper end (the end faces 80*a*-80*d*) of the ink-extracting pipe 12, 112 is relatively large. In this case, when each ink cartridge 1, 100 has been removed form the mounting portion 3 for replacement with a new ink cartridge 1, 100, a height position of the surface of the ink in the ink-extracting-pipe 12, 112 is substantially equal to a height position of the lower end of each of the communication openings 81*a*-81*d*, which lower end is located on the side of the mounting portion 3. When the ink is extracted from the new ink cartridge 1, 100 by mounting it on the mounting portion 3 with the height position of the ink surface in the ink-extracting pipe 12, 112 substantially equal to the height position of the lower end of each communication opening 81*a*-81*d*, the air whose volume corresponds to a volume of a space from the upper opening of the ink-extracting pipe 12, 112 to the ink surface enters the ink-extracting pipe 12, 112, undesirably disturbing smooth ink ejection of the recording head 7. In this case, a known air-sucking operation for restoring the recording head 7 needs to be frequently carried out.

By determining the size of each ink-extract communication opening 81*a*-81*d* such that its depth is held within a range in which the ink in the ink-extracting pipe 12, 112 substantially reaches the end faces 80*a*-80*d* of the ink-extracting pipe 12, 112 owing to surface tension of the ink, as shown in FIG. 10, the space from the upper opening of the ink-extracting pipe 12, 112 to the ink surface can be minimized to minimize the amount of the air entering the ink-extracting pipe 12, 112 when the ink is extracted from the new ink cartridge 1, 100 by mounting it on the mounting portion 3, so as to prevent the ink ejection of the recording head 7 from being adversely influenced. More specifically described by referring to FIG. 10, the ink-extract communication openings 81*a*-81*d* have the following size, for instance, in which the inside diameter "D" of the ink-extracting pipe 12, 112 is 1.6 mm, the depth "H" of the ink-extract communication openings 81*a*-81*d* is 0.5 mm, and the width of the communication openings 81-81*d* as seen in the circumferential direction of the ink-extracting pipe 12, 112 is 0.4 mm.

In view of the air-discharging function of the air-discharge passage 310 formed in the ink-extracting pipe 112 of the second embodiment, the air-discharge passage 310 may be formed through the thickness of the peripheral wall of the ink-extracting pipe 112 in its radial direction for communication between the ink-extract passage 92 of the ink-extracting pipe 112 and the exterior. If the air-discharge passage 310 is formed as described above, the height position of the ink surface in the ink-extracting pipe 112 is lowered to a height position of the lower end of the air-discharge passage 310 when the ink cartridge 1, 100 is removed from the mounting portion 3, undesirably causing the problem of entering of the air into the ink-extracting pipe 112, as described above with respect to the depth of the communication openings 81*a*-81*d*. In view of this, it is preferable that a part of the entire length of the air-discharge passage 310, which part extends beyond the depth of each ink-extract communication opening 81*a*-81*c*, is formed as a groove which does not penetrate through the thickness of the peripheral wall of the ink-extracting pipe 112.

While, in the illustrated second embodiment, one air-discharge passage 310 is provided, a plurality of air-discharge passages 310 may be formed in the peripheral wall of the ink-extracting pipe 112. The provision of the plurality of air-discharge passages 310 is effective to improve the efficiency of discharging the air in the guide passage 140 and the opening 141 and to prevent the air from flowing into the ink-extract passage 92 of the ink-extracting pipe 112. Where the plurality of air-discharge passages are formed, the air-discharge passages may be arranged such that they are spaced apart from each other with a constant spacing distance and such that each air-discharge passage is located intermediate between adjacent two of the ink-extract communication openings 81*a*-81*d*.

In the illustrated second embodiment, the air-discharge passage 310 is constituted by a generally linear or straight groove formed in the peripheral wall of the ink-extracting pipe 112. The grove constituting the air-discharge passage 310 may be otherwise shaped. For instance, the groove may be curved or bent.

Moreover, while the air-discharge passage 310 is formed in the peripheral wall of the ink-extracting pipe 112 in the illustrated second embodiment, the air-discharge passage 310 may be constituted by an inside passage formed within the peripheral wall of the ink-extracting pipe 112.

The air-discharge passage 310 provided in the ink-extracting pipe 112 of the second embodiment may be provided in the ink-extracting pipe 12 of the first embodiment.

In the illustrated first embodiment, the ink cartridge 1 is used in combination with the ink-extracting pipe 12. In the illustrated second embodiment, the ink cartridge 100 is used in combination with the ink-extracting pipe 112 having the air-discharge passage 310. The ink cartridge 1 of the first embodiment may be used in combination with the ink-extracting pipe 112 having the air-discharge passage 310. The ink cartridge 100 of the second embodiment may be used in combination with the ink-extracting pipe 12.

In the illustrated first and second embodiments, the end face of each of the ink-extracting pipe 12, 112 and air-introducing pipe 13 is generally flat. The configuration of the end face is not limited to that of the illustrated embodiments. Where the end face is other than flat, the configuration of the bottom surface of the valve member 32, 52, 132 may be changed so as to correspond to the configuration of the end face. One example of the configuration of the end face is hemispherical.

It is to be understood that the invention is not limited to the details of the illustrated embodiments, but may be embodied with various changes, modifications and improvements, which may occur to those skilled in the art, without departing from the spirit and scope of the invention.

What is claimed is:

1. An ink-jet recording apparatus, comprising:

a recording head which ejects ink to perform recording; and an ink-extracting member which has an ink-extract passage as an inner passage formed therein and which is to be removably connected to an ink cartridge that stores ink for extracting the ink from the ink cartridge to supply the ink to the recording head, wherein the ink-extracting member is to be connected to the ink cartridge including: (a) an ink-outlet valve member which shuts off a flow of the ink from the ink cartridge and which establishes a state in which the ink can be extracted from the ink cartridge by the ink-extracting member when the ink-outlet valve member is pressed by the ink-extracting member which abuts on the ink-outlet valve member upon connection of the ink-extracting member to the ink cartridge; and (b) a seal which is disposed downstream of the ink-outlet valve member and into which the ink-extracting member is inserted so that the seal comes into close contact with an outer surface of the ink-extracting member, wherein the ink-extracting member further includes, at an end portion thereof, an end face which abuts on the ink-outlet valve member, and at least one ink-extract communication opening which is formed at the end portion and which is formed in a peripheral wall of the ink-extracting member, so as to communicate with the ink-extract passage, and wherein the at least one ink-extract communication opening is disposed, in a state in which the ink-extracting member is connected to the ink cartridge, at a position nearer to the ink-outlet valve member than a portion of the ink-extracting member with which the seal comes into close contact.

2. The ink-jet recording apparatus according to claim 1, wherein the end face of the ink-extracting member is generally flat.

3. The ink-jet recording apparatus according to claim 1, wherein the ink-extracting member has an end opening which is open in the end face thereof and to which the ink-extract passage is open, and each of the at least one ink-extract communication openings is a cutout which is formed at an end of the peripheral wall of the ink-extracting member and which is open in the end face.

4. The ink-jet recording apparatus according to claim 3, wherein the ink-extracting member is disposed such that the end opening is open upwards and the at least one ink-extract communication opening is formed so as to have a size determined such that an outer periphery of a surface of the ink in the ink-extracting member substantially reaches the end face of the ink-extracting member, the surface of the ink being concave owing to surface tension.

5. The ink-jet recording apparatus according to claim 1, wherein the at least one ink-extract communication opening consists of a plurality of ink-extract communication openings which are formed in the peripheral wall so as to be spaced apart from each other with a substantially constant spacing distance.

6. The ink-jet recording apparatus according to claim 1, wherein the ink-extracting member is formed of a resin material.

7. The ink-jet recording apparatus according to claim 1, wherein the ink-extracting member has at least one air-discharge passage for discharging air existing in a space located downstream of the ink-outlet valve member out into an exterior of the ink cartridge, upon insertion of the ink-extracting member into the seal.

8. The ink-jet recording apparatus according to claim 7, wherein the at least one air-discharge passage is formed so as to be held in communication with the exterior of the ink cartridge until the ink-extracting member substantially abuts on the ink-outlet valve member.

9. The ink-jet recording cartridge according to claim 7, wherein the at least one air-discharge passage is arranged such that communication between the space located downstream of the ink-outlet valve member and the exterior of the ink cartridge is shut off by the seal when the state in which the ink can be extracted from the ink cartridge by the ink-extracting member is established.

10. The ink-jet recording apparatus according to claim 7, wherein each of the at least one air-discharge passage is a groove formed in the outer surface of the ink-extracting member.

11. The ink-jet recording apparatus according to claim 1, comprising an air-introducing member which has an air-introduce passage as an inner passage formed therein and which is to be removably connected to the ink cartridge for introducing air into the ink cartridge, wherein the air-introducing member is to be connected to the ink cartridge including an air-inlet valve member which shuts off a flow of the air into the ink cartridge and which establishes a state in which the air can be introduced into the ink cartridge by the air-introducing member when the air-inlet valve member is pressed by the air-introducing member which abuts on the air-inlet valve member upon connection of the air-introducing member to the ink cartridge, and wherein the air-introducing member includes, at an end portion thereof, an end face which abuts on the air-inlet valve member, and at least one air-introduce communication opening which is formed at the end portion and which is formed in a peripheral wall of the air-introducing member, so as to communicate with the air-introduce passage.

12. The ink-jet recording apparatus according to claim 11, wherein the end face of the air-introducing member is generally flat.

13. The ink-jet recording apparatus according to claim 11, wherein the ink-extracting member and the air-introducing member are the same in shape.

14. An ink-jet recording apparatus, comprising:

a recording head which ejects ink to perform recording;

an ink cartridge which stores ink; and an ink-extracting member which has an ink-extract passage as an inner passage formed therein and which is to be removably connected to the ink cartridge for extracting the ink from the ink cartridge to supply the ink to the recording head, wherein the ink cartridge includes: (a) an ink-outlet valve member which shuts off a flow of the ink from the ink cartridge and which establishes a state in which the ink can be extracted from the ink cartridge by the ink-extracting member when the ink-outlet valve member is pressed by the ink-extracting member which abuts on the ink-outlet valve member upon connection of the ink-extracting member to the ink cartridge; and (b) a seal which is disposed downstream of the ink-outlet valve member and into which the ink-extracting member is inserted so that the seal comes into close contact with an outer surface of the ink-extracting member, wherein the ink-extracting member further includes, at an end portion thereof, an end face which abuts on the ink-outlet valve member and at least one ink-extract communication opening which is formed at the end portion and which is formed in a peripheral wall of the ink-extracting member, so as to communicate with the ink-extract passage, and wherein the at least one ink-extract communication opening is disposed, in a state in which the ink-extracting member is connected to the ink cartridge, at a position nearer to the ink-outlet valve member than a portion of the ink-extracting member with which the seal comes into close contact.

15. The ink-jet recording apparatus according to claim 14, wherein the end face of the ink-extracting member is generally flat.

16. An ink-jet recording apparatus, comprising:

a recording head which ejects ink to perform recording; and an ink-extracting member which has an ink-extract passage as an inner passage formed therein and which is to be removably connected to an ink cartridge that stores ink for extracting the ink from the ink cartridge to supply the ink to the recording head, wherein the ink-extracting member is to be connected to the ink cartridge including: an ink-outlet valve member which shuts off a flow of the ink from the ink cartridge and which establishes a state in which the ink can be extracted from the ink cartridge by the ink-extracting member when the ink-outlet member is pressed by the ink-extracting member which abuts on the ink-outlet valve member upon connection of the ink-extracting member to the ink cartridge; and a seal which is disposed downstream of the ink-outlet valve member and into which the ink-extracting member is inserted so that the seal comes into close contact with an outer surface of the ink-extracting member, and wherein the ink-extracting member further includes: at least one ink-extract communication opening which is disposed, in a state in which the ink-extracting member is connected to the ink cartridge, at a position nearer to the ink-outlet valve member than a portion of the ink-extracting member with which the seal comes into close contact; and at least one air-discharge passage for discharging air existing in a space located downstream of the ink-outlet valve member out into an exterior of the ink cartridge, upon insertion of the ink-extracting member into the seal.

* * * * *